US010591859B2

(12) United States Patent
Matsuda

(10) Patent No.: US 10,591,859 B2
(45) Date of Patent: Mar. 17, 2020

(54) IMAGE FORMING DEVICE AND IMAGE FORMING METHOD

(71) Applicant: SHARP KABUSHIKI KAISHA, Sakai, Osaka (JP)

(72) Inventor: Kyohko Matsuda, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/092,759

(22) PCT Filed: Dec. 28, 2016

(86) PCT No.: PCT/JP2016/089113
§ 371 (c)(1),
(2) Date: Oct. 10, 2018

(87) PCT Pub. No.: WO2017/179248
PCT Pub. Date: Oct. 19, 2017

(65) Prior Publication Data

US 2019/0137918 A1 May 9, 2019

(30) Foreign Application Priority Data

Apr. 11, 2016 (JP) ..... 2016-078974

(51) Int. Cl.
*G03G 15/16* (2006.01)
*G03G 15/00* (2006.01)
(Continued)

(52) U.S. Cl.
CPC ..... *G03G 15/5029* (2013.01); *G03G 15/00* (2013.01); *G03G 15/16* (2013.01);
(Continued)

(58) Field of Classification Search
CPC ..... G03G 15/5029; G03G 15/1695; G03G 21/203; G03G 15/00; G03G 15/16; G03G 15/1675; G03G 15/1665; G03G 15/23
See application file for complete search history.

(56) References Cited

U.S. PATENT DOCUMENTS 8,750,732 B2 * 6/2014 Ishii ..... G01N 21/4738 324/754.23
8,761,656 B2 * 6/2014 Saka ..... G03G 15/5029 250/559.36

(Continued)

FOREIGN PATENT DOCUMENTS

JP H04-077649 A 3/1992
JP H05-107945 A 4/1993

(Continued)

*Primary Examiner* — Hoang X Ngo
(74) *Attorney, Agent, or Firm* — ScienBiziP, P.C.

(57) ABSTRACT

The invention achieves uniform image quality for every transfer regardless of a moisture content on a surface of a paper sheet when a plurality of transfer processes is to be made on a single paper. A copier (1A) is provided with a optical sensor (20) which includes at least one light source, illuminates a paper sheet (P) with light, receives the light reflected from the paper sheet (P), and measures the received light intensity. Before each of a plurality of transfer processes, the copier (1A) calculates a moisture content on a surface of the paper sheet (P) from the light intensity measured by the optical sensor (20), and sets a transfer condition of a transfer device (15) based on the calculated moisture content on the surface of the paper sheet (P).

13 Claims, 13 Drawing Sheets

(51) Int. Cl.
*G03G 21/20* (2006.01)
*G03G 15/23* (2006.01)

(52) U.S. Cl.
CPC ..... *G03G 15/1695* (2013.01); *G03G 15/1665* (2013.01); *G03G 15/1675* (2013.01); *G03G 15/23* (2013.01); *G03G 21/203* (2013.01)

(56) References Cited

U.S. PATENT DOCUMENTS

| | | | | |
|---|---|---|---|---|
| 2005/0180767 | A1* | 8/2005 | Ishii ..... | G03G 15/6532 399/66 |
| 2007/0200568 | A1 | 8/2007 | Shioda et al. | |
| 2013/0259505 | A1* | 10/2013 | Zaretsky ..... | G03G 15/1675 399/66 |
| 2015/0362870 | A1 | 12/2015 | Ogushi et al. | |

FOREIGN PATENT DOCUMENTS

| | | | |
|---|---|---|---|
| JP | H07-056402 | A | 3/1995 |
| JP | H07-234556 | A | 9/1995 |
| JP | 2006-052069 | A | 2/2006 |
| JP | 2007-052113 | A | 3/2007 |
| JP | 2007-058081 | A | 3/2007 |
| JP | 2007-218662 | A | 8/2007 |
| JP | 2008-268385 | A | 11/2008 |
| JP | 2016-004128 | A | 1/2016 |

* cited by examiner

IMAGE FORMING DEVICE AND IMAGE FORMING METHOD

TECHNICAL FIELD

The present disclosure relates to an image forming device capable of forming images on a single paper sheet a plurality of times, and an image forming method in the image forming device.

BACKGROUND ART

In an image forming device such as a copier and a printer, a toner agent (a developing agent) is transferred to a paper sheet to form (print) an image on the paper sheet. More particularly, in an image forming device, a transfer device to which transfer voltage is applied and transfer current is supplied transfers a developed image (toner image) carried on an image carrier (photoconductor) to a paper sheet, whereby printing is carried out.

In such an image forming device, images can be printed on both a front surface and a back surface of a paper sheet. However, in both-sided printing, transfer properties of toner images to the paper sheet are different between an image printed on one surface (hereinafter, referred to as a first side) of a paper sheet and an image printed on the other surface (hereinafter, referred to as a second side) of the paper sheet. This may cause a problem that the image printed on the first side and the image printed on the second side are not the same in quality.

FIG. 12 is a graph showing a change in a moisture content on surfaces of a paper sheet during both-sided printing on the paper sheet. FIG. 13 is a graph showing a relationship between a moisture content on a surface of a paper sheet and a surface resistance value of the paper sheet. A reason for the occurrence of the above problem will be described with reference to FIGS. 12 and 13. That is, when printing an image on a paper sheet, a fixing device heats to fuse toner that has been transferred to the paper sheet, and causes the toner to be fixed to the paper sheet. At this time, when heated by the fixing device, a moisture content on the surface of the paper sheet evaporates and, as illustrated in FIG. 12, the moisture content on the surface of the paper sheet after a fixing process is lowered significantly. Therefore, the moisture content in the paper sheet when a transfer process is performed to the second side is significantly lower than the moisture content in the paper sheet when the transfer process is performed to the first side. Here, as illustrated in FIG. 13, it is known that the lower the moisture content on the surface of the paper sheet becomes, the higher the electrical resistivity on the surface of the paper sheet becomes. Not using a transfer voltage in accordance with the electric resistivity on the surface of the paper sheet may cause poor transfer of toner to the paper sheet by the transfer device, that is, uneven density and lack of applied toner. As a result, image reproducibility is impaired. Therefore, when the transfer process is to be performed to the second side of which moisture content has changed, if the transfer is performed under the same transfer condition as in the transfer process in the first side, the image printed on the first side and the image printed on the second side are not the same in quality.

In view of the above problem, a technique to make a difference in quality of images printed on the first side and the second side smaller is disclosed in PTL 1.

In the image forming device disclosed in PTL 1, a voltage to be applied to a transfer device can be switched into two transfer voltages. In the image forming device, the transfer voltage in printing on the second side is set to be larger than the transfer voltage in printing on the first side, whereby a difference in quality between the image printed on the first side and the image printed on the second side is made to be smaller.

CITATION LIST

Patent Literature

PTL 1: Japan Patent Laid-Open "Japanese Unexamined Patent Application Publication No. H5-107945" (published on Apr. 30, 1993)

SUMMARY OF THE INVENTION

Problems to be Solved by the Invention

However, in the image forming device disclosed in PTL 1, a transfer voltage in printing on the first side and a transfer voltage in printing on the second side are previously-determined voltage values and, therefore, are not determined considering a moisture content on the surface of the paper sheet. Therefore, when, for example, the moisture content in the paper sheet is higher than usual, like in the rainy season and in the early morning in the winter season, or in dry foreign areas where the moisture content on the surface of the paper sheet is low, the transfer voltage in printing on the first side does not become an appropriate voltage value, or the moisture content in the first side and moisture content in the second side significantly differ from each other. Therefore, there is a problem that quality of the image printed on the first side and quality of the image printed on the second side mutually differ significantly depending on the moisture content on the surface of the paper sheet.

One aspect of the invention has been provided in view of the above problem, and an object thereof is to provide an image forming device and an image forming method capable of achieving uniform quality of image for every transfer regardless of a moisture content on a surface of a paper sheet when a plurality of transfer processes is to be made on a single paper sheet.

Means for Solving the Problems

To solve the above problem, an image forming device according to one aspect of the invention is an image forming device provided with an image carrier that carries a developed image obtained by developing an electrostatic latent image based on image data with a developing agent, and a transfer unit that performs a transfer process to transfer the developed image to a paper sheet, in which the transfer process is capable of being performed on a single paper sheet a plurality of times, the image forming device including: a measurement unit provided with at least one light source, configured to illuminate the paper sheet with light, receive the light reflected from the paper sheet, and measure intensity of the received light; and a setter configured to, before each of the plurality of times of the transfer processes, calculate a moisture content on a surface of the paper sheet from the light intensity measured by the measurement unit, and set a transfer condition of the transfer unit in accordance with the calculated moisture content on the surface of the paper sheet.

To solve the above problem, an image forming method according to one aspect of the invention is an image forming method in an image forming device provided with an image carrier that carries a developed image obtained by developing an electrostatic latent image based on image data with a developing agent, and a transfer unit that performs a transfer process to transfer the developed image to a paper sheet, in which the transfer process is capable of being performed on a single paper sheet a plurality of times, the image forming method including: a measuring step of illuminating the paper sheet with light from at least one light source, receiving the light reflected from the paper sheet, and measuring intensity of the received light; and a setting step of, before each of the plurality of times of the transfer processes, calculating a moisture content on a surface of the paper sheet from the light intensity measured in the measuring step, and setting a transfer condition of the transfer unit in accordance with the calculated moisture content on the surface of the paper sheet.

Effect of the Invention

One aspect of the invention has an effect to provide an image forming device and an image forming method capable of achieving uniform quality of image for every transfer regardless of a moisture content on a surface of a paper sheet when a plurality of transfer processes is to be made on a single paper sheet.

MODE FOR CARRYING OUT THE INVENTION

Embodiment 1

Hereinafter, a copier 1A as an image forming device in Embodiment 1 of the invention will be described in detail with reference to FIG. 1 to FIG. 6. The copier 1A prints image data (forms an image) on a paper sheet P.

(Structure of Copier 1A)

Figure 1:
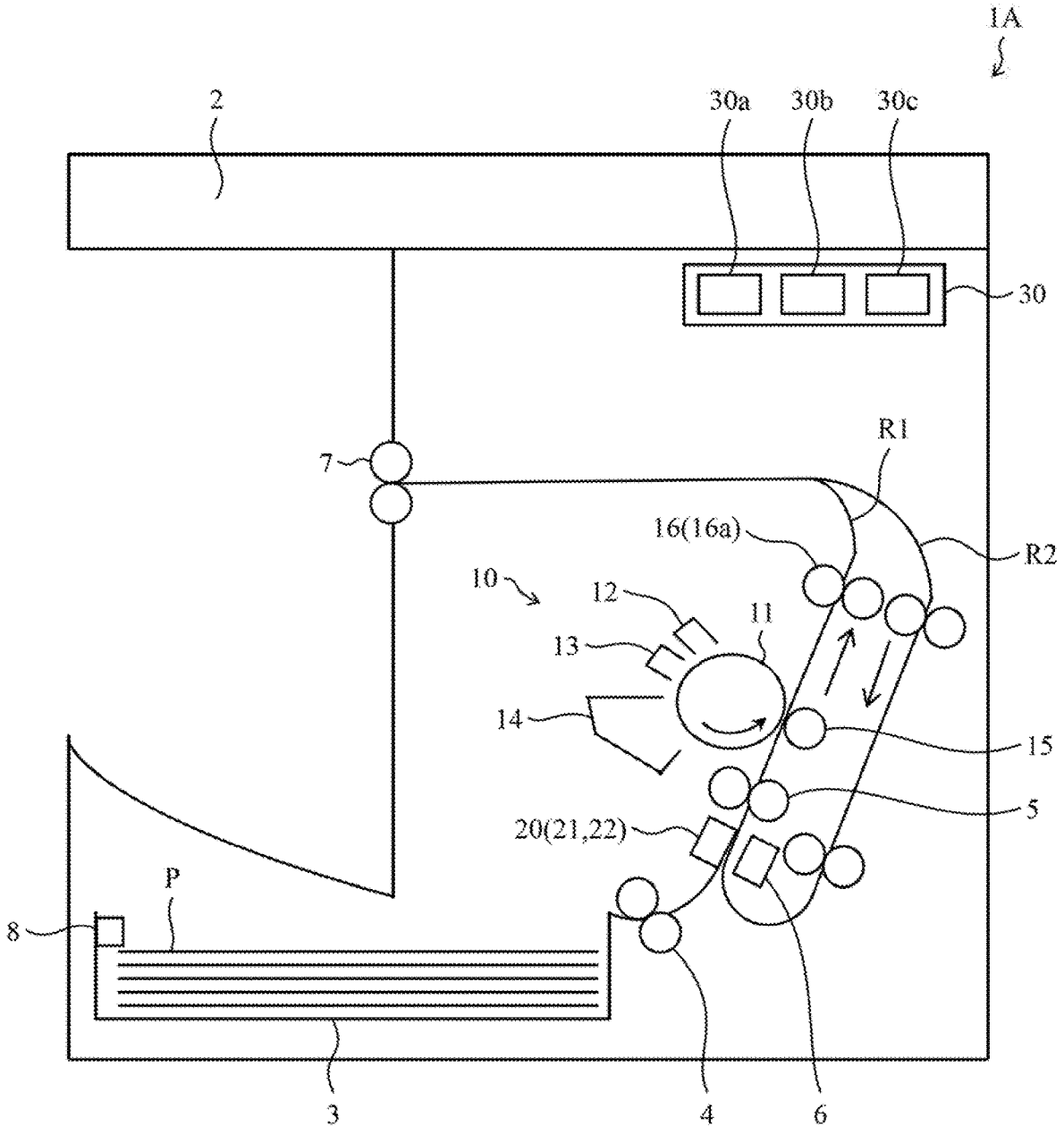
FIG. 1 is a schematic diagram illustrating a structure of a copier according to Embodiment 1 of the invention.

A structure of the copier 1A according to the present embodiment will be described with reference to FIG. 1. FIG. 1 is a schematic diagram illustrating the structure of the copier 1A.

As illustrated in FIG. 1, the copier 1A includes a scanner unit 2, a paper feed cassette 3, pickup rollers (feed rollers) 4, a pre-registration sensor, (not illustrated), idle rollers (stop rollers) 5, an image forming unit 10, an optical sensor (measurement unit) 20, a standard reflecting plate 6, paper discharge rollers 7, an environment measurement unit 8, and a controller 30.

The scanner unit 2 is used to read image data (original data) of an original placed on a document tray (not illustrated). The image data read by the scanner unit 2 is transmitted to memory 30*a* of the controller 30 or an image processor 30*b* described later.

The paper feed cassette 3 is a container containing paper sheets P on which printing is carried out by the copier 1A.

The pickup rollers 4 are rollers for supplying a paper sheet P contained in the paper feed cassette 3 into a main conveyance channel R1. The main conveyance channel R1 is a conveyance channel starting at the paper feed cassette 3, passing through the image forming unit 10, and ending at the paper discharge rollers 7.

The pre-registration sensor is a switch disposed between the optical sensor 20 described later and the idle rollers 5 on the main conveyance channel R1. Upon detecting that the paper sheet P supplied by the pickup rollers 4 has passed through a position of the pre-registration sensor, the pre-registration sensor transmits a signal to the idle rollers 5 described later. In the copier 1A according to the present embodiment, the pre-registration sensor is disposed between the optical sensor 20 and the idle rollers 5, but this arrangement is not restrictive. The position at which the pre-registration sensor is disposed may be a position at which the pre-registration sensor can detect that the paper sheet P supplied by the pickup rollers 4 has passed through the position of the pre-registration sensor, and can transmit a detection signal to the idle rollers 5.

The idle rollers 5 are rollers for temporarily stopping the paper sheet P. Upon receiving a detection signal from the pre-registration sensor indicating that the paper sheet P has passed through, the idle rollers 5 temporarily stops the paper sheet P, and cancels the stop of the paper sheet P at predetermined timing.

The image forming unit 10 is used to print an image indicated by image data of an original read by the scanner unit 2 on the paper sheet P. The image forming unit 10 includes a photosensitive drum (image carrier) 11, a charger 12, a laser scanning unit 13, a developing device 14, a transfer device (transfer unit) 15, a fuser 16, and a cleaning device (not illustrated).

Here, a basic print operation to the paper sheet P by the image forming unit 10 will be described. A detailed print operation in the copier 1A will be described later.

In the printing in the image forming unit 10, the image forming unit 10 first uniformly charges the photosensitive drum 11 to a predetermined voltage by the charger 12. The photosensitive drum 11 is drum-shaped and rotates in the direction of arrow illustrated inside of the photosensitive drum 11 in FIG. 1.

The image forming unit 10 then causes the laser scanning unit 13 to expose the photosensitive drum 11 with a laser beam. The above process forms, on a surface of the photosensitive drum 11, an electrostatic latent image based on the image data that has been subject to image processing.

The image forming unit 10 then causes the developing device 14 to apply a toner agent (developing agent) contained in the developing device 14 to the surface of the photosensitive drum 11, and forms a toner image (developed image) based on the electrostatic latent image described above developed on the surface of the photosensitive drum 11. In particular, the developing device 14 includes a developing roller (not illustrated) to which a developing bias is applied. A potential difference caused by a developing bias applied to the developing roller and a charged condition on the surface of the photosensitive drum 11 causes the toner agent to apply to the surface of the photosensitive drum 11. Therefore, a toner image based on the electrostatic latent image is developed on the surface of the photosensitive drum 11.

Next, the image forming unit 10 causes the transfer device 15 to perform a transfer process of transferring the toner image developed on the surface of the photosensitive drum 11 to the paper sheet P. In particular, the image forming unit 10 applies a transfer potential to the transfer device 15 and supplies a transfer current, thereby transferring the toner image developed on the surface of the photosensitive drum 11 to the paper sheet P. The transfer potential applied to the transfer device 15 and the current supplied to the transfer device 15 are set by an arithmetic processor 30*c* described later.

Next, the image forming unit 10 causes the fuser 16 to fix (secure) the toner image transferred to the paper sheet P. In particular, the fuser 16 includes a pressure roller 16*a* and a halogen lamp (not illustrated) as a heat source, and heats, by using the halogen lamp, the paper sheet P to which the toner image has transferred, and pressurizes the paper sheet P with predetermined pressure by using the pressure roller 16*a*. This fuses the toner image transferred to the paper sheet P and fixes (secures) to the paper sheet P.

In the image forming unit 10, as described above, the photosensitive drum 11 carries the toner image obtained by developing the electrostatic latent image based on the image data by using the toner agent. Then, the transfer device 15 performs a transfer process of transferring the toner image to the paper sheet P, and an image indicated by the image data is printed on the paper sheet P. The copier 1A is capable of performing a plurality of times of transfer processes on a single paper sheet P. Copiers 1B and 1C described later are capable of performing the same transfer process.

The image forming unit 10 causes the cleaning device to remove the toner agent remaining on the surface of the photosensitive drum 11 after the transfer, and causes the charger 12 to uniformly charge the photosensitive drum 11 to a predetermined voltage. Therefore, the photosensitive drum 11 is prepared for the next print process.

Figure 2:
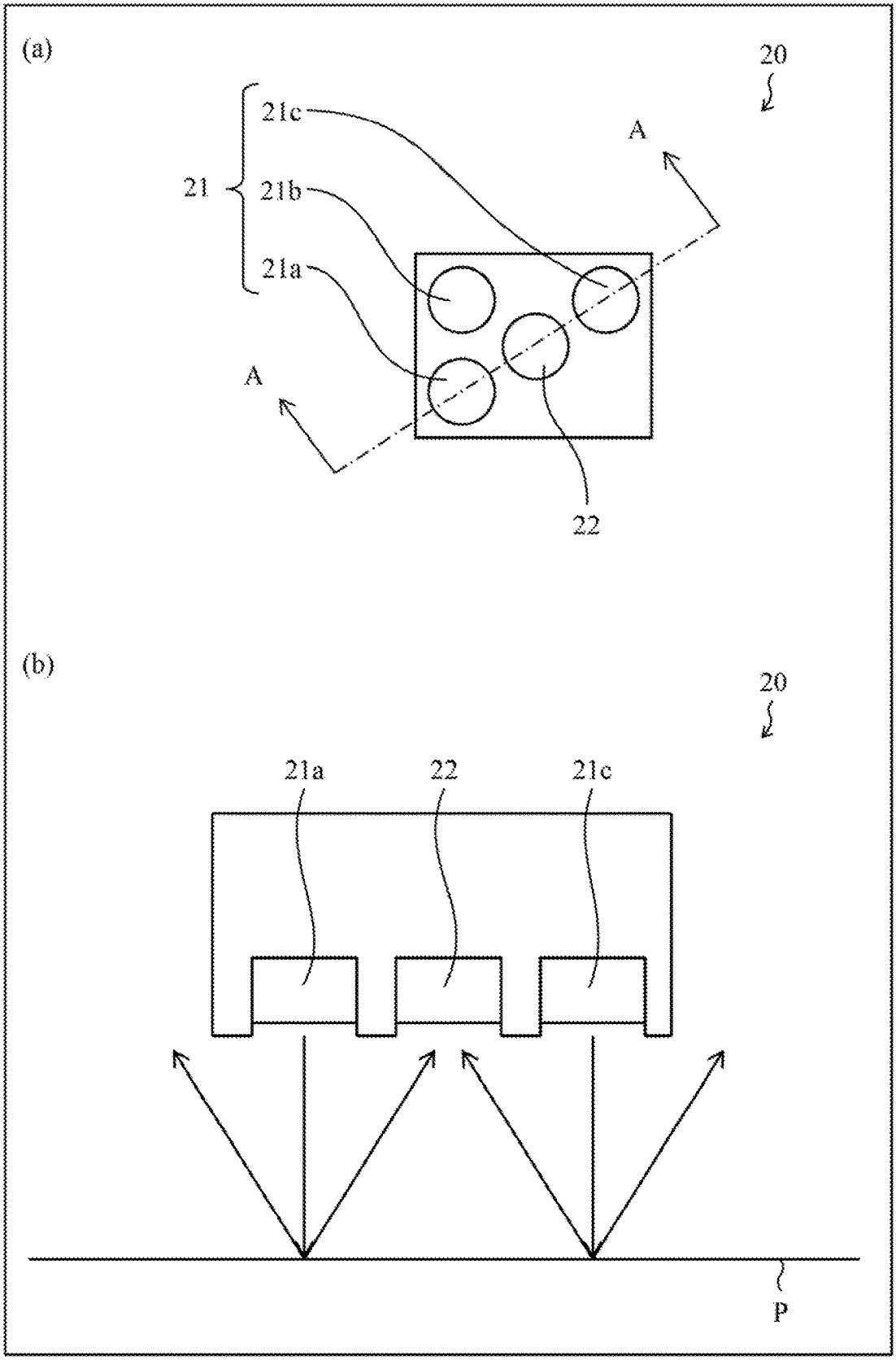
FIG. 2 illustrates a structure of an optical sensor of the copier, with (a) being a schematic view of a structure of the optical sensor, and (b) being a cross-sectional view of (a) along line A-A.

Next, a structure of the optical sensor 20 will be described with reference to FIG. 2. FIG. 2 illustrates a structure of the optical sensor 20 of the copier A according to the present embodiment, with (a) being a schematic view of the structure of the optical sensor, and (b) being a cross-sectional view of (a) along line A-A.

The optical sensor 20 is used to illuminate the paper sheet P with light and measure intensity of light reflected from the surface of the paper sheet P. In particular, the optical sensor 20 illuminates the paper sheet P stopped by the idle rollers 5 with light, receives light reflected from the paper sheet P. and measures intensity of the received light. The light intensity measured by the optical sensor 20 is used for the calculation of the moisture content on the surface of the paper sheet P described later. The optical sensor 20 includes, as illustrated in FIGS. 2(*a*) and 2(*b*), an illuminator 21 and a photodetector 22.

The illuminator 21 is used to emit light onto the paper sheet P. The illuminator 21 according to the present embodiment includes, as illustrated in FIG. 2(*a*), three semiconductor light emitting elements (light emitting diodes (LED): light sources) 21*a*, 21*b*, and 21*c* as light sources. The illuminator 21 is capable of illuminating (emitting) three types of light of different wavelengths onto the paper sheet P from the semiconductor light emitting elements 21*a*, 21*b*, and 21*c*. According to the present embodiment, the semiconductor light emitting elements 21*a*, 21*b*, and 21*c* are arranged to surround the photodetector 22.

according to the present embodiment, the wavelengths of light emitted by the semiconductor light emitting elements 21*a*, 21*b*, and 21*c* are 2,000 nm or shorter. Note that the wavelength of light emitted by the illuminator 21 according to one aspect of the invention is not limited to 2,000 nm or shorter. However, if the wavelength of light exceeds 2,000 nm, absorption of illuminated light by the moisture in the paper sheet P becomes excessively larger, and accuracy in the calculation of the moisture content on the surface of the paper sheet P described later decreases. For this reason, the wavelength of light illuminated from the illuminator 21 is desirably 2,000 nm or less. According to the present embodiment, the illuminator 21 includes the semiconductor light emitting elements 21*a*, 21*b*, and 21*c* as light sources. However, the structure of the illuminator according to one aspect of the present invention is not limited to the same. As the light source of the illuminator according to one aspect of the invention, a light source capable of illuminating light of a wavelength with which the moisture content is calculable may be used. For example, a halogen lamp or a fluorescent substance may be used. When using a halogen lamp or a fluorescent substance, a wavelength filter that transmits light of different wavelengths may be, for example, provided to illuminate three types of light of different wavelengths onto the paper sheet P. The number, the wavelengths, the intensity of light, and the like of the light sources of the illuminator 21 are selected depending on, for example, the structure of the copier 1A and the type of the paper sheet P to be measured. To improve accuracy in the calculation of the moisture content on the surface of the paper sheet P described later, light illuminated from the illuminator 21 desirably has at least two wavelengths.

Note that, depending on the purpose, the number of light sources provided in the illuminator according to one aspect of the invention may be one. When the light source provided in the illuminator according to one aspect of the invention is a light source having an emission wavelength range, such as an LED, a halogen lamp, or a fluorescent substance, the emitted light includes a plurality of wavelengths. By using this property, light of different wavelengths may be emitted from a single light source. Illumination of light of different wavelengths from a single light source can be implemented by, for example, combining or switching members that transmit certain wavelengths such as an optical filter.

As illustrated in FIG. 2(*b*), the photodetector 22 is used to receive light illuminated from the semiconductor light emitting elements 21*a*, 21*b*, and 21*c* of the illuminator 21, and reflected from the paper sheet P. The photodetector 22 outputs, to the memory 30*a* of the controller 30, the received light intensity. In particular, the photodetector 22 includes a single light receiving element, and outputs, to the memory 30*a* of the controller 30, an electric signal of size depending on the intensity of light received by the light receiving element. A wave range (that is, a wavelength of light range capable of being subject to photo-electric translation by the light receiving element) in which the light receiving element can detect light is selected to include the wavelength of light illuminated from the illuminator 21. The light receiving element according to the present embodiment is formed by a photodiode. In a copier according to one aspect of the invention, however, the light receiving element is not limited to a photodiode. The light receiving element may be, for example, a phototransistor, an avalanche photodiode, and a photo multiplier.

The number and arrangement of the light receiving elements provided in the photodetector 22, and the like are appropriately selected depending on, for example, the structure of the copier 1A, the type of the paper sheet P to measure, and the wavelength of light to be illuminated from the illuminator 21. For example, the photodetector 22 may include three photodiodes corresponding to the semiconductor light emitting elements 21*a*, 21*b*, and 21*c*, respectively.

Figure 3:
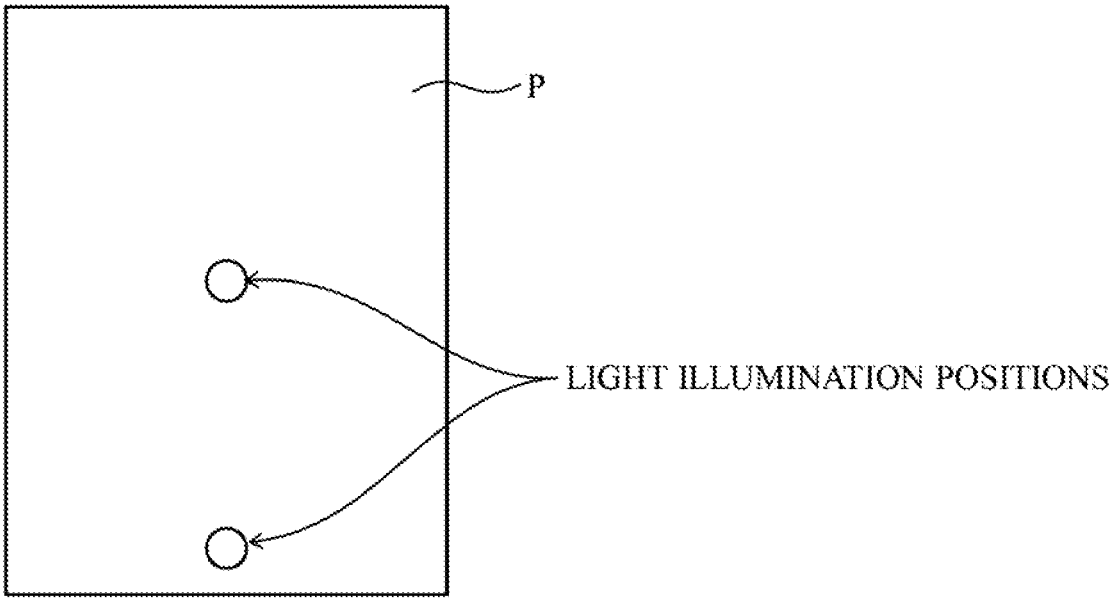
FIG. 3 is a top view of a paper sheet illustrating positions illuminated with light from the optical sensor.

Generally, paper (paper sheet P) has a nature that it more easily holds moisture at end positions than the central position. This means that the moisture content in the paper sheet P varies depending on the positions in the paper sheet P. Therefore, in the copier 1A according to the present embodiment, the moisture content on the surface of the paper sheet P is calculated considering variation in the moisture content in the paper sheet P. Here, positions at which the paper sheet P is illuminated with light from the optical sensor 20 will be described with reference to FIG. 3. FIG. 3 is a top plan view of the paper sheet P illustrating positions on the paper sheet P illuminated with light from the optical sensor 20. As illustrated in FIG. 3, the optical sensor 20 illuminates the paper sheet P at two positions. In particular, as a first measurement, the optical sensor 20 first illuminates the paper sheet P stopped by the idle rollers 5 with light. The idle rollers 5 then convey the paper sheet P a predetermined amount and cause the paper sheet P to be stopped again. As a second measurement, the optical sensor 20 illuminates the paper sheet P with light at a position different from the position illuminated at the first time. One of the first illumination position and the second illumination position is the central position of the paper sheet P and the other is the end position of the paper sheet P. That is, the optical sensor 20 measures intensity of light reflected from the surface of the paper sheet P at the central position and the end position of the paper sheet P. In this manner, in the calculation of the moisture content on the surface of the paper sheet P described later, by, for example, using a mean value of the first measurement result and the second measurement result and calculating the moisture content on the surface of the paper sheet P, an influence of distribution of the moisture content on the surface of the paper sheet P can be reduced when calculating the moisture content on the surface of the paper sheet P. Note that the positions on the paper sheet P illuminated with light from the optical sensor 20 may be three or more.

Next, intensity of light illuminated by the illuminator 21 will be described.

Figure 4:
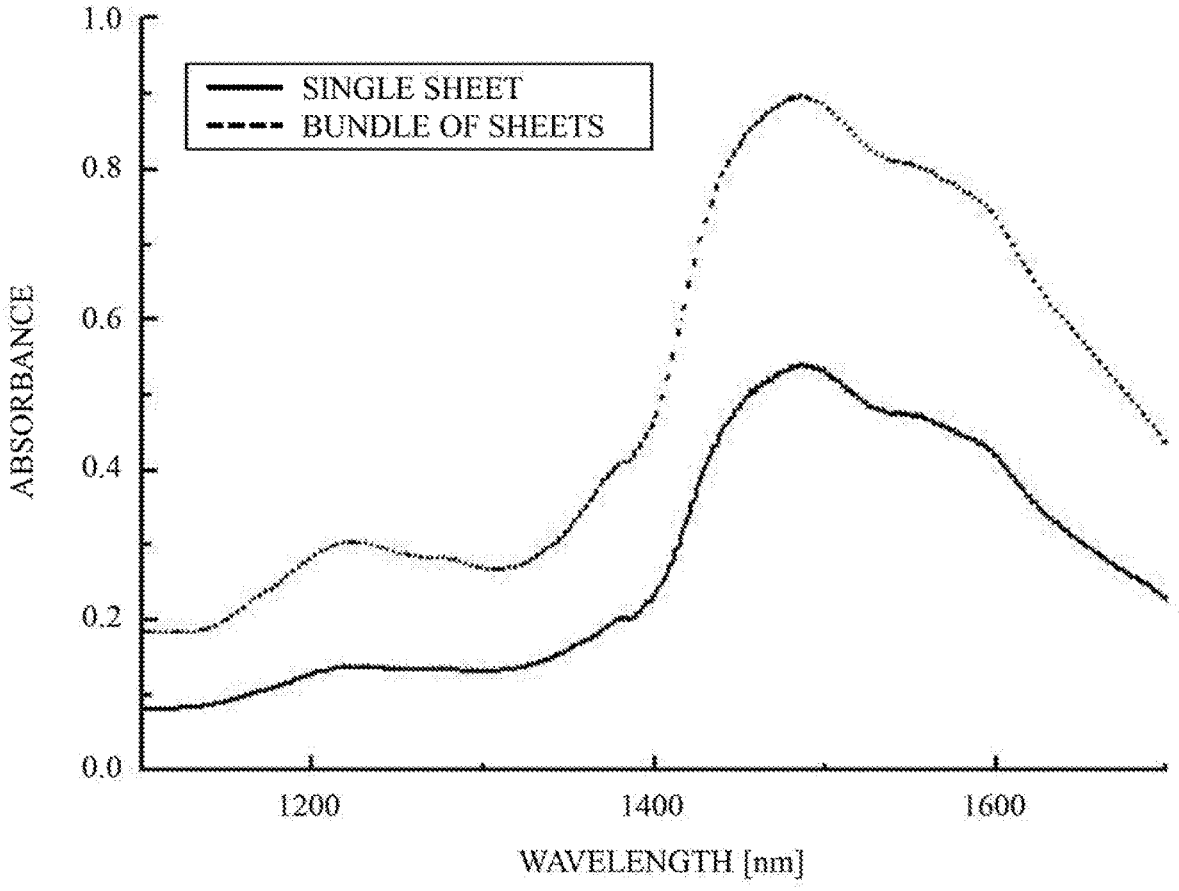
FIG. 4 is a graph showing absorbance spectra of a paper sheet when intensity of light illuminated from an illuminator of the optical sensor is high.

Here, a problem caused when intensity of light illuminated from the illuminator 21 is high will be described with reference to FIG. 4. FIG. 4 is a graph showing absorbance spectra of the paper sheet P when intensity of light illuminated from the illuminator 21 is high. FIG. 4 illustrates an absorbance spectrum measured with a single paper sheet P, and an absorbance spectrum measured with a bundle of paper sheets P (specifically, a bundle of approximately 500 paper sheets P).

When intensity of light illuminated from the illuminator 21 is high, a part of the light illuminated from the illuminator 21 penetrates the paper sheet P. If, for example, other paper sheets P are positioned ahead of the light that has penetrated the paper sheet P (for example, if the paper sheet P is in a bundle state in FIG. 4), a part of the penetrated light is absorbed by the paper sheets P that are positioned ahead. As a result, because intensity of light to be received by the photodetector 22 is lowered, absorbance of the paper sheet P is calculated to be greater than actual when calculating absorbance on the surface of the paper sheet P described later.

If a component inside of the copier 1A is positioned ahead of the light that has penetrated the paper sheet P (when a single paper sheet P is positioned in FIG. 4), a part of the penetrated light is reflected and scattered by that component. Since the light reflected and scattered by that component contains a lot of information other than the information about the moisture content on the surface of the paper sheet P, the light becomes a noise source in the absorbance spectrum of the paper sheet P. Therefore, when the light reflected and scattered by that component is received by the photodetector 22, the moisture content on the surface of the paper sheet P cannot be calculated accurately. In the graph in which the paper sheet P is in a bundle state in FIG. 4, absorption of light by, for example, paper sheets below the paper sheet P appears to be an offset of a detection value of the photodiode. In the graph in which the paper sheet P is a single sheet in FIG. 4, reflection and scattering of light by the component of the copier 1A positioning below the paper sheet P appears to be distortion in a spectral line shape. Therefore, a rise in the base line or distortion in the spectral line shape in the entire wavelength region may become noise that causes detection values to become incorrect values.

As described above, when intensity of light illuminated from the illuminator 21 is high, a part of the light illuminated from the illuminator 21 penetrates the paper sheet P, whereby intensity of light to be received by the photodetector 22 changes. As a result, the moisture content on the surface of the paper sheet P cannot be calculated accurately.

To solve the above problem, in the copier 1A according to the present embodiment, intensity of light illuminated from the illuminator 21 is set in advance so that an amount of light penetrating the paper sheet P is small among the light illuminated onto the paper sheet P. That is, the light to be received by the photodetector 22 is set in advance to be light having mainly passed through the inside of substantially thin film on the surface of the paper sheet P. Specifically, intensity of light illuminated by the illuminator 21 is set so that, if an amount of light illuminated from the illuminator 21, reflected from the surface of a first paper sheet P, and is received by the photodetector 22 is a light amount P1, and an amount of light illuminated from the illuminator 21, penetrating the first paper sheet P, reflected from an object other than the first paper sheet P (for example, another paper sheet P positioning below the first paper sheet P), and is received by the photodetector 22 is a light amount P2, the light amount P2 is equal to or smaller than 10% of the light amount P1.

A thickness of the paper sheet P varies depending on the type of the paper sheet P. Therefore, in the copier 1A according to the present embodiment, intensity of light illuminated from the illuminator 21 is set in advance so that the light amount P2 becomes equal to or smaller than 10%° of the light amount P1 for several types of usually used paper sheets P of different thicknesses. For each type of usually used paper sheets P, driving currents for the semiconductor light emitting elements 21*a*, 21*b*, and 21*c* constructing the illuminator 21 may be set in advance, and the driving currents of the semiconductor light emitting elements 21*a*, 21*b*, and 21*c* may be changed in accordance with the type of the paper sheet P set by a user.

The illuminator 21 and the photodetector 22 are waterproofed by a fitting cover made of a transparent member of which wavelength characteristic transmits light. The transparent member may be, for example, quartz glass or synthetic quartz glass.

The standard reflecting plate 6 is a reflector for reflecting light illuminated from the illuminator 21 of the optical sensor 20 to the photodetector 22 of the optical sensor 20 in a state in which no paper sheet P is positioned between the optical sensor 20 and the standard reflecting plate 6, and is provided to face the optical sensor 20. In the copier 1A according to the present embodiment, the standard reflecting plate 6 is provided at a position opposite to the optical sensor 20 with reference to the main conveyance channel R1. However, in the copier according to one aspect of the invention, the position at which the standard reflecting plate 6 is provided is not limited to the same. The position at which the standard reflecting plate 6 is provided may be a position at which the light illuminated from the illuminator 21 and is reflected from the standard reflecting plate 6 can be received by the photodetector 22 directly without being interrupted. The standard reflecting plate 6 may be built in the optical sensor 20. The standard reflecting plate 6 is made of a material with high reflectance and, according to the present embodiment, is made of polytetrafluoroethylene (PTFE). Intensity of light illuminated from the illuminator 21, reflected from the surface of the standard reflecting plate 6, and received by the photodetector 22 is used as data for reference in the calculation of the moisture content in the paper sheet P described later.

The paper discharge rollers 7 are rollers for discharging the paper sheet P printed thereon into a paper discharge tray (not illustrated). The paper discharge rollers 7 are capable of rotating two directions: a direction in which the paper sheet P is discharge outside and the opposite direction thereof.

The environment measurement unit 8 is provided inside of the paper feed cassette 3, and measures a temperature around the paper sheets P contained in the paper feed cassette 3. Note that the position at which the environment measurement unit 8 is provided is not limited to the position illustrated in FIG. 1 in the copier according to one aspect of the invention, but the environment measurement unit 8 may be provided at any position near the paper sheets P contained in the paper feed cassette 3 and at which the temperature can be measured.

The copier 1A includes a sub-conveying channel R2. The sub-conveyance channel R2 is a conveyance channel used when printing on the paper sheet P several times (for example, on both sides). The sub-conveyance channel R2 is branched from the main conveyance channel R1 at a position between the fuser 16 and the paper discharge rollers 7, and is a conveyance channel connecting the pickup rollers 4 and the optical sensor 20 on the main conveyance channel R1 from the branch point.

A branching pawl (not illustrated) is provided at the branch point. The branching pawl can be operated into two sides. When the branching pawl is operated to a first side (the main conveyance channel R1 side), the paper sheet P having passed through the fuser 16 is conveyed to the paper discharge rollers 7. When the branching pawl is operated on a second side (the sub-conveyance channel R2 side) and the paper discharge rollers 7 are rotated in the direction opposite to the direction in which the paper sheet P is disposed into the paper discharge tray, the paper sheet P conveyed with the paper discharge rollers 7 is conveyed in the direction opposite to the travelling direction on the main conveyance channel R1 (that is, the paper sheet P is switched back) and is conveyed from the branch point to the sub-conveyance channel R2. The paper sheet P conveyed to the sub-conveyance channel R2 is conveyed between the pickup rollers 4 and the optical sensor 20 on the main conveyance channel R1 through the sub-conveyance channel R2. At this time, the paper sheet P is inverted in front/rear and up/down directions from the state in which the paper sheet P has passed through the image forming unit 10 immediately before. Therefore, printing can be made on the paper sheet P a plurality of times.

The controller 30 controls operation of each component. The controller 30 includes memory (storage) 30*a*, an image processor 30*b*, and an arithmetic processor (setter) 30*c*.

The memory 30*a* is used to store information necessary for printing in the copier 1A. Specifically, the memory 30*a* includes an area for temporarily storing image data read by the scanner unit 2, an area for storing various programs to be executed by the image processor 30*b* and the arithmetic processor 30*c* (for example, programs for a print process and for calculating the moisture content), and storing data to be used in the programs, an area in which the program is loaded and, a working area used when the programs are executed. Further, the memory 30*a* includes an area for storing, for example, control data inside of the copier 1A such as the voltage and the current to be applied and supplied in each element of the image forming unit 10 that are changed in accordance with the conditions set by the user, and calculation models used for the calculation of the moisture content on the surface of the paper sheet P.

The image processor 30*b* is used to perform image processing to the image data read by the scanner unit 2.

The arithmetic processor 30*c* performs each calculation in the copier 1A. For example, the arithmetic processor 30*c* calculates the moisture content on the surface of the paper sheet P from the light intensity measured by the optical sensor 20 and, based on the calculated moisture content on the surface of the paper sheet P, sets a transfer condition of the transfer device 15. Details of a calculation method of the moisture content on the surface of the paper sheet P will be described later.

Each process in the image processor 30*b* and the arithmetic processor 30*c* is implemented by a central processing unit (CPU).

(Calculation of Moisture Content on Surface of Paper Sheet P)

Next, the calculation method of the moisture content on the surface of the paper sheet P in the copier 1A will be described in detail.

The illuminator 21 of the optical sensor 20 first illuminates the paper sheet P temporarily stopped by the idle rollers 5 with light. The light illuminated from the illuminator 21 onto the paper sheet P is reflected from the paper sheet P after being transmitted or scattered (including multiple scattering) while being absorbed by the moisture contained in the paper sheet P inside of significantly thin film on the surface of the paper sheet P.

Next, the photodetector 22 of the optical sensor 20 receives the light reflected from the paper sheet P. At this time, the light reflected from the paper sheet P includes information about the moisture content on the surface of the paper sheet P, specifically, information about absorbance on the surface of the paper sheet P. The light intensity measured by the photodetector 22 is output to the memory 30*a* of the controller 30. As described above, measurement of light intensity by the optical sensor 20 is performed at two positions of the paper sheet P: the central position and an end position.

Next, in the arithmetic processor 30*c* of the controller 30, the moisture content on the surface of the paper sheet P is calculated by using light intensity measured by the optical sensor 20. Hereinafter, the calculation method of the moisture content on the surface of the paper sheet P will be described in detail.

In the calculation of the moisture content on the surface of the paper sheet P, the arithmetic processor 30*c* first calculates absorbance on the surface of the paper sheet P from the intensity of the light reflected from the paper sheet P measured by the optical sensor 20. Specifically, the arithmetic processor 30*c* calculates absorbance on the surface of the paper sheet P by following the Lambert-Beer law or using the Kubelka-Munk function with light intensity measured by the optical sensor 20 by using the standard reflecting plate 6 as reference data. Absorbance on the surface of the paper sheet P is calculated for each of the three types of the light of different wavelengths illuminated from the semiconductor light emitting elements 21*a*, 21*b*, and 21*c* of the illuminator 21 of the optical sensor 20.

Next, the arithmetic processor 30*c* calculates the moisture content on the surface of the paper sheet P by using the calculated absorbance on the surface of the paper sheet P. According to the present embodiment, the arithmetic processor 30*c* calculates the moisture content on the surface of the paper sheet P by using a multiple regression analysis as a calculation model. The multiple regression analysis is a method in which a relational expression between absorbance of each wavelength and the moisture content is statistically obtained in advance. Specifically, the arithmetic processor 30*c* calculates the moisture content on the surface of the paper sheet P by using the following expression (1) with absorbency of three different wavelengths being λ1, λ2, and λ3.

$$\text{Moisture content}=A\times\lambda 1+B\times\lambda 2\times C\times\lambda 3+D \quad (1)$$

Here, coefficients A, B, C, and D are determined by conditions such as the wavelength of light illuminated from the illuminator 21, the type of the paper sheet P designated by the user, and an internal structure of the copier 1A. Coefficients in accordance with various conditions are calculated in advance, and stored in the memory 30*a*. The arithmetic processor 30*c* calculates the moisture content on the surface of the paper sheet P by using absorbance obtained from a measurement result measured by the optical sensor 20 and the coefficients A, B, C, and D read from the memory 30*a*.

As described above, the copier 1A according to the present embodiment calculates the moisture content on the surface of the paper sheet P by using absorbance on the surface of the paper sheet P. It is known that absorbance on the surface of the paper sheet P is proportional to the moisture content in the paper sheet P. and the moisture content in the paper sheet P can be calculated accurately by calculating absorbance on the surface of the paper sheet P. The moisture content can be calculated by using transmittance, reflectance, or the like of the paper sheet P. However, since transmittance and reflectance are not proportional with the moisture content, calculation of the moisture content by using transmittance or reflection is more complicated as compared with calculation of the moisture content by using absorbance.

(Print Operation of Copier 1A)

Figure 5:
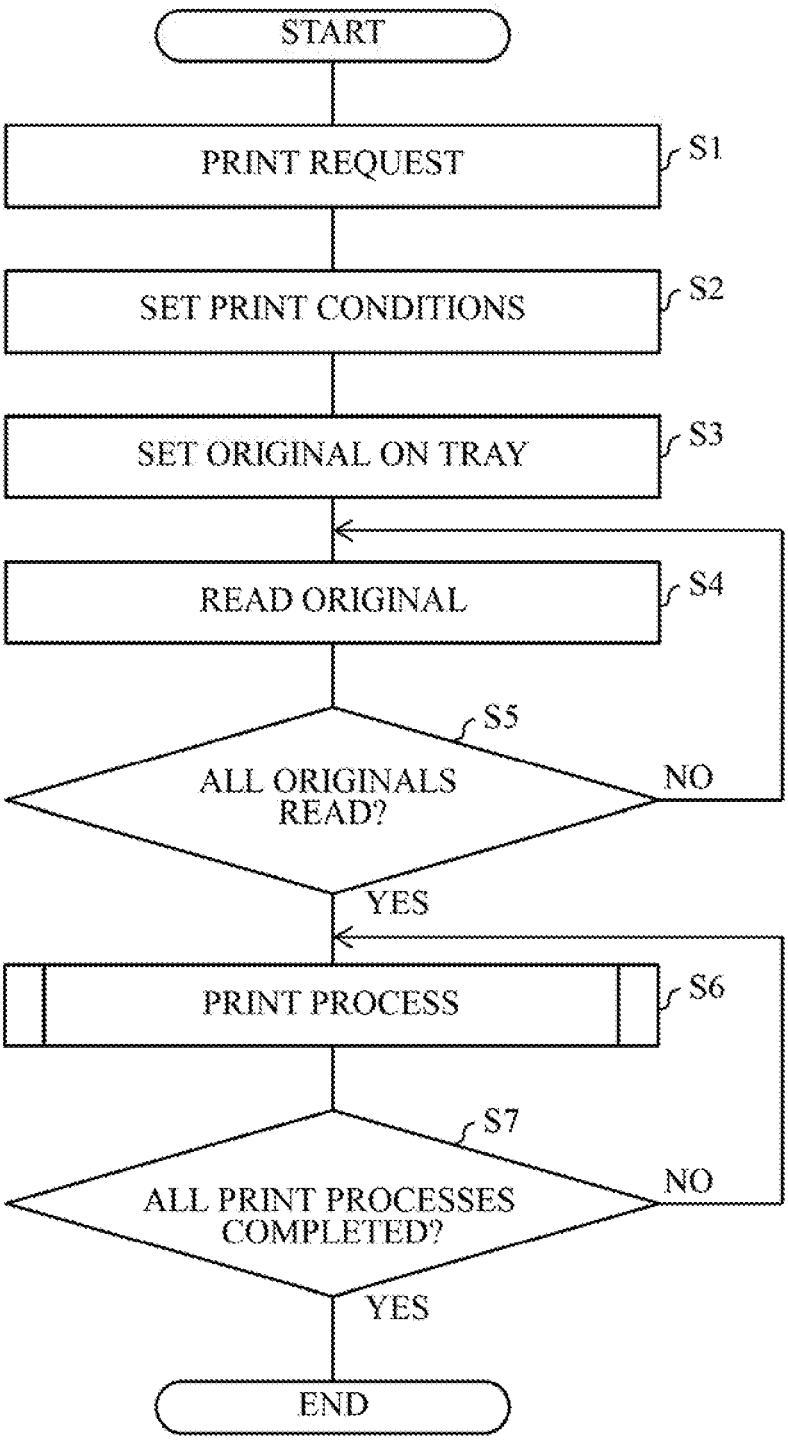
FIG. 5 is a flowchart showing operation of performing both-sided printing on a paper sheet by using the above copier.

Next, the print operation of the copier 1A according to the present embodiment will be described with reference to FIG. 5. In particular, operation of both-sided printing performed by the copier 1A to the paper sheet P will be described. FIG. 5 is a flowchart showing operation of both-sided printing on the paper sheet P performed by the copier 1A. The operation described below is controlled by the controller 30 unless otherwise noted. Hereinafter, description will be given with one of the sides of the paper sheet P being a first side and the other of the sides being a second side.

As shown in FIG. 5, when a print request is made by a user (S1), the copier 1A sets print conditions specified by the user, such as the number of printing, printing magnification, the size of the paper sheet P, and single-sided/double-sided printing (S2).

Next, an original is placed on a document tray of the scanner unit 2 by the user (S3). This step (S3) may be performed before the user makes the print request (S1).

Then, the controller 30 causes the scanner unit 2 to read original data (image data) (S4). Here, operation to read image data on both sides (a front surface and a back surface) of a single original will be described. In the operation of reading image data, the scanner unit 2 reads image data on the front surface of the original. The read image data on the front surface of the original is transmitted to the memory 30*a* and stored in the memory 30*a*. Next, the scanner unit 2 reads image data on the back surface of the original. The read image data on the back surface of the original is transmitted to the image processor 30*b* without being transmitted to the memory 30*a*. The image data on the back surface of the original that has been transmitted to the image processor 30*b* is subject to image processing by the image processor 30*b*, and transmitted to the laser scanning unit 13 of the image forming unit 10, where the data is used for the printing on the first side of the paper sheet P. Subsequently, the image data on the front surface of the original that is stored in the memory 30*a* is transmitted to the image processor 30*b*. The image data on the front surface of the original that has been transmitted to the image processor 30*b* is subject to image processing by the image processor 30*b*, and transmitted to the laser scanning unit 13 of the image forming unit 10, where the data is used for the printing on the second side of the paper sheet P.

Next, the controller 30 determines whether all of the image data of the original has been read (S5). If originals to be read still remain (S5: NO), image data of the next original is read (that is, step S4 is repeated).

Figure 6:
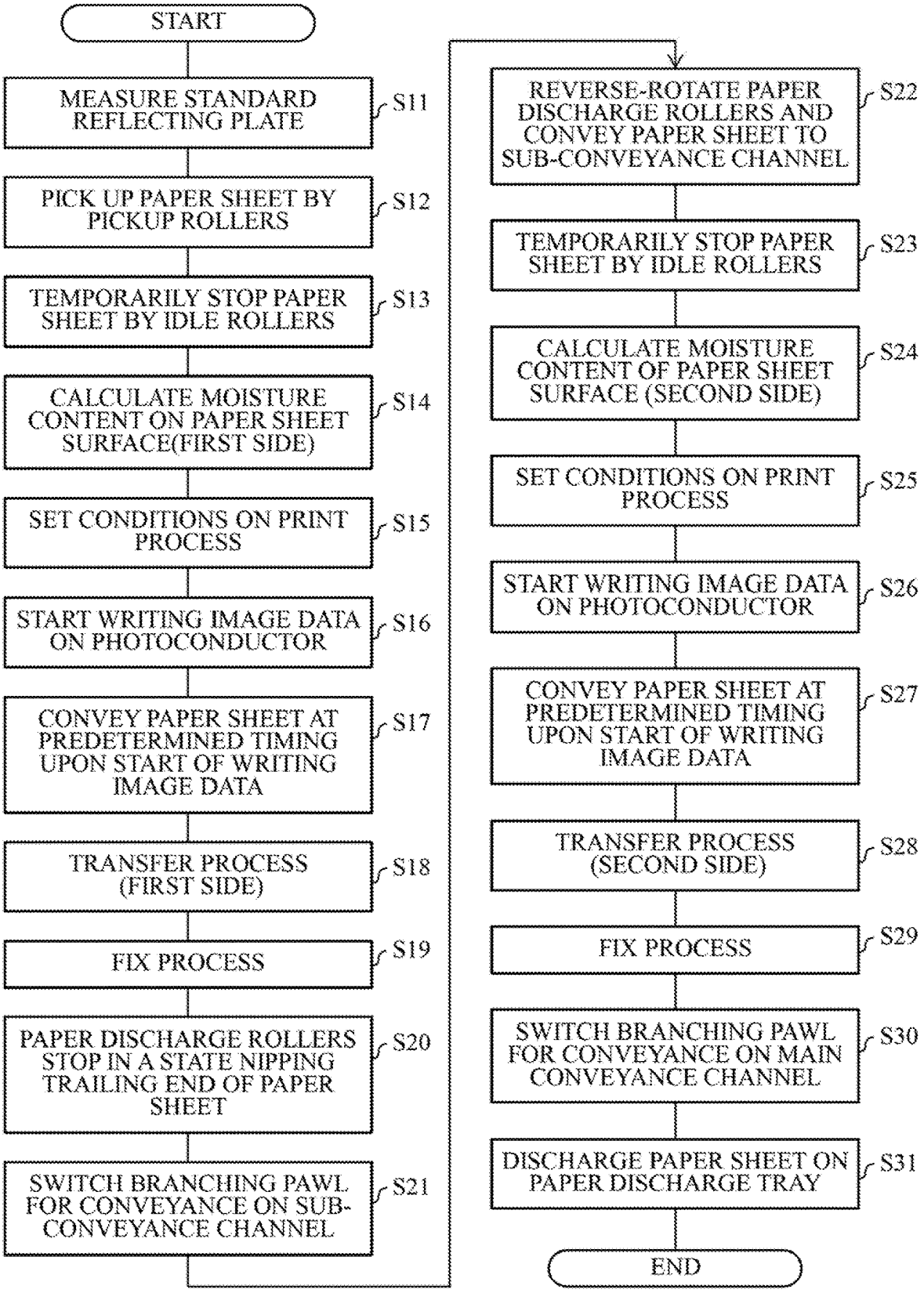
FIG. 6 is a flowchart showing operation of a print process in the above copier.

If, on the other hand, reading of all the image data of the originals has been completed (S5: YES), the copier 1A performs printing on the paper sheet P (S6, print process). Here, the print process (S6) to the paper sheet P by the copier 1A will be described with reference to FIG. 6. FIG. 6 is a flowchart showing operation of the print process (image forming method) in the copier 1A.

In the print process on the paper sheet P by the copier 1A, the optical sensor 20 first measures reference data to be used in the calculation of the moisture content on the surface of the paper sheet P described later by using the standard reflecting plate 6 (S11). Specifically, the optical sensor 20 causes the illuminator 21 to illuminate the standard reflecting plate 6 with light, causes the photodetector 22 to receive light reflected from the surface of the standard reflecting plate 6, measures intensity of the received light, and transmits the measured light intensity to the memory 30*a* of the controller 30.

The pickup rollers 4 then take one of the paper sheets P contained in the paper feed cassette 3 and convey to the main conveyance channel R1 (S12).

Next, when the paper sheet P is conveyed on the main conveyance channel R1, the pre-registration sensor detects passing of the paper sheet P and transmits a detection signal to the idle rollers 5. Upon receiving the detection signal from the pre-registration sensor, the idle rollers 5 temporarily stop the paper sheet P conveyed on the main conveyance channel R1 (S13).

Then, the arithmetic processor 30*c* calculates the moisture content on the surface of the first side of the paper sheet P (S14, measurement step). The calculation method has been described above.

Next, the arithmetic processor 30*c* sets conditions on the print process by using the moisture content on the surface of the first side of the paper sheet P calculated by the arithmetic processor 30*c* (S15, setting step). Specifically, the arithmetic processor 30*c* sets print conditions designated by the user, the type of the paper sheet P, and environment conditions measured by the environment measurement unit 8. Also, the arithmetic processor 30*c* sets transfer conditions by using a relational database shown in the following Table 1 based on the moisture content on the surface of the first side of the paper sheet P calculated by the arithmetic processor 30*c* (that is, the voltage value applied to the transfer device 15 and the current value supplied to the transfer device 15). In particular, the transfer conditions are set in advance for each predetermined range of the moisture content on the surface of the first side of the paper sheet P calculated by the arithmetic processor 30*c*, and the arithmetic processor 30*c* sets the transfer conditions based on the transfer condition set in advance and the moisture content on the surface of the first side of the paper sheet P. The transfer conditions may be set in the order of, for example, 1% of the moisture content on the surface of the first side of the paper sheet P as shown in Table 1. When it is desirable to divide the condition more finely, the transfer conditions may be set in a finer range, for example, in the order of 0.5%. Alternatively, the transfer conditions may be set in a range at or exceeding a threshold, for example, "15% or greater." This range is set in accordance with the specification of the image forming device, climates of the region in which the image forming device is used, and the like, as necessary. In an image forming device according to one aspect of the invention, at least one of the voltage value applied to the transfer device 15 and the current value supplied to the transfer device IS may be set. The transfer voltage and the transfer current set by the arithmetic processor 30*c* are output to the transfer device 15.

Next, the controller 30 starts writing of image data onto the surface of the photosensitive drum 11 (S16). Specifically, on the surface of the photosensitive drum 11 charged by the charger 12, an electrostatic latent image of image data that has been subject to image processing by the image processor 30*b* is formed by the laser scanning unit 13. Subsequently, operation of the developing device 14 applying the toner agent to the electrostatic latent image and developing a toner image is started. That is, after the laser scanning unit 13 starts writing image data on the surface of the photosensitive drum 11, the developing device 14 continues the writing process about that image data.

Next, the controller 30 cancels stopping of the paper sheet P by the idle rollers 5 at predetermined timing upon start of writing image data on the surface of the photosensitive drum 11 (S17). That is, the controller 30 cancels the stop of the paper sheet P by the idle rollers 5 so that the toner image developed on the photosensitive drum 11 is transferred to a predetermined position of the paper sheet P by the transfer device 15.

Next, the transfer device 15 transfers the toner image developed on the photosensitive drum 11 to the first side of the paper sheet P (S18). The transfer voltage applied to the transfer device 15 and the transfer current supplied to the transfer device 15 are the transfer voltage and the transfer current set in the arithmetic processor 30*c*.

Next, the fuser 16 fixes the toner image transferred to the first side of the paper sheet P by the transfer device 15 to the paper sheet P (S19). Then, printing on the first side of the paper sheet P is completed.

Next, the paper sheet P having been subject to a print process on the first side is conveyed on the main conveyance channel R1 upon rotation of the paper discharge rollers 7 and reaches the paper discharge rollers 7. When the paper sheet P reaches the paper discharge rollers 7, a trailing end of the paper sheet P in a direction in which the paper sheet P is discharged is temporarily stopped in a state nipped by the paper discharge rollers 7 (S20).

Then, the controller 30 switches the branching pawl into the sub-conveyance channel R2 side (S21).

Next, the controller 30 conveys the paper sheet P to the sub-conveyance channel R2 by rotating the paper discharge rollers 7 in the opposite direction (S22). This reverses the first side and the second side from the state in which the paper sheet P has passed through the image forming unit 10 immediately before, and the paper sheet P is conveyed between the pickup rollers 4 and the optical sensor 20 on the main conveyance channel R1.

TABLE 1

| | | | | TRANSFER CONDITIONS | |
|---|---|---|---|---|---|
| PRINT CONDITIONS | MOISTURE CONTENT | ENVIRONMENTAL CONDITIONS (TEMPERATURE) | PAPER TYPE | TRANSFER CHARGER APPLY VOLTAGE | TRANSFER CHARGER SUPPLY CURRENT VALUE |
| HIGH RESOLUTION DENSE REDUCE | 7%-8% | 10° C.-15° C. | REGULAR PAPER | +1.6 kV | LARGE |
| . . . | | | | | |
| . . . | 8%-8.5% | 20° C.-30° C. | QUALITY PAPER | +1.2 kV | SMALL |
| . . . | . . . | . . . | . . . | . . . | . . . |
| . . . | . . . | . . . | . . . | . . . | . . . |

Then, as in step S13, the idle rollers 5 temporarily stop the paper sheet P conveyed on the main conveyance channel R1 (S23).

Next, by the same calculation method as in step S14, the arithmetic processor 30*c* calculates the moisture content on the surface of the second side of the paper sheet P (S24, measurement step). The arithmetic processor 30*c* sets conditions on the print process with respect to the second side of the paper sheet P by using the relational database shown in Table 1 as in step S15 (S25, setting step).

Before being subject to the fixing process by the fuser 16, a part of the moisture on the surface of the paper sheet P evaporates. As a result, the moisture content on the surface of the second side of the paper sheet P is lower than the moisture content on the surface of the first side of the paper sheet P calculated in step S14. Therefore, in the copier 1A according to the present embodiment, the arithmetic processor 30*c* calculates the moisture content on the surface of the second side of the paper sheet P before performing the print process on the second side of the paper sheet P and, based on the calculated moisture content, sets the transfer conditions. This makes quality of the image printed on the first side and quality of the image printed on the second side of the paper sheet P the same. According to the present embodiment, the controller 30 sets the conditions on the print process based on Table 1 in step S25 as in step S15, but setting of the conditions on the print process is not limited to the same. The conditions on the print process may be set dedicatedly for the second side, or may be set by using a relational database, a correspondence list, or the like.

Next, the image forming unit 10 performs printing on the second side of the paper sheet P (S26 to S29). Because the print operation (steps S26 to S29) on the second side of the paper sheet P is the same as the print operation (S16 to S19) on the first side of the paper sheet P, description will be omitted.

When the print process is performed on the second side, the controller 30 switches the branching pawl to the main conveyance channel R1 side (S30). This allows the paper sheet P to be conveyed to the paper discharge rollers 7 from the fuser 16. Switching of the branching pawl in step 30 may be performed at any timing after the paper sheet P is conveyed to the sub-conveyance channel R2.

Next, the paper sheet P passes through the paper discharge rollers 7 and is discharged in the paper discharge tray (S31).

Then, the print process (S6) on a single paper sheet P by the copier 1A is completed.

Next, as shown in FIG. 5, the controller 30 determines whether the printing required by the user has been completed (S7). If the required printing has not been completed (S7: NO), specifically, if a requested number of sheets have not been printed in a case in which there is a print request for a plurality of sheets for a single original, or if printing of other originals has not been completed, the controller 30 repeats step S6. If, on the other hand, the required printing has been completed (S7: YES), all of the print processes are completed and the copier 1A enters a standby state.

As described above, in the copier 1A according to the present embodiment, the arithmetic processor 30*c* calculates absorbance on the surface of the paper sheet P based on the intensity of light reflected from the surface of the paper sheet P measured by the optical sensor 20. The arithmetic processor 30*c* calculates the moisture content on the surface of the paper sheet P by using absorbance on the surface of the calculated paper sheet P and, depending on the calculated moisture content, sets the voltage value to apply to the transfer device 15 and the current value to supply to the transfer device 15. This setting is performed by calculating the moisture content on the corresponding first side or second side of the paper sheet P before printing on (transferring to) the first side or the second side. The arithmetic processor 30*c* sets the voltage value to apply to the transfer device 15 and the current value to supply to the transfer device 15 in each printing event.

According to the above structure, in each of the printing on the first side and the printing on the second side, the voltage value to apply to the transfer device 15 and the current value to supply to the transfer device 15 can be appropriately set considering the moisture content on the surface of the first side and the second side of the paper sheet P. Therefore, regardless of the moisture content on the surface of the paper sheet P, quality of the image transferred to the first side and quality of the image transferred to the second image can be made the same.

In the copier 1A according to the present embodiment, the optical sensor 20 measures intensity of light reflected from the surface of the paper sheet P at two positions: the central position and an end position of the paper sheet P. The arithmetic processor 30*c* calculates the moisture content on the surface of the paper sheet P at each position and sets the transfer conditions by using a mean value thereof. Therefore, an influence of distribution of the moisture content on the surface of the paper sheet P in setting the transfer conditions on the paper sheet P can be reduced.

The copier 1A according to the present embodiment has a configuration such that the optical sensor 20 measures intensity of light of the paper sheet P temporarily caused to be stopped by the idle rollers 5 before conveying the paper sheet P to the photosensitive drum 11.

Therefore, because the optical sensor 20 can measure the light intensity in the state in which the paper sheet is stopped by the idle rollers 5, time required for printing can be shortened.

In the copier 1A according to the present embodiment, the arithmetic processor 30*c* calculates the moisture content on the surface of both the first side and the second side of the paper sheet P by using the optical sensor 20. This allows reduction in space and cost compared to a case where the optical sensor is provided individually for calculating the moisture content on the surface of each of the first side and the second side.

In the copier 1A according to the present embodiment, the arithmetic processor 30*c* calculates the moisture content on the surface of the paper sheet P by using the multiple regression analysis. That is, the arithmetic processor 30*c* calculates the moisture content by using a calculation formula obtained statistically in advance. Therefore, the moisture content on the surface of the paper sheet P can be calculated accurately compared with a conventional calculation method in which the moisture content is calculated by merely correlating reflectance or absorbance and moisture content. In a conventional calculation method, it is not unusual that an error of equal to or greater than 5% occurs in the value of the moisture content, but the copier 1A according to the present embodiment can calculate the moisture content accurately. Therefore, the transfer conditions can be set in the order of 1% or 0.5% as shown in, for example, Table 1. Therefore, the arithmetic processor 30*c* is capable of suitably setting the transfer conditions to the paper sheet P.

In the description of the print operation above, the operation to perform both-sided printing on a single paper sheet P has been described, but the print operation of the copier 1A according to the present embodiment is not limited to the same. A plurality of times of print processes may be performed on the same single paper sheet P.

In the copier 1A according to the present embodiment, the arithmetic processor 30*c* uses the multiple regression analysis as a calculation model when calculating the moisture content on the surface of the paper sheet P. However, the image forming device according to one aspect of the invention is not limited to this. The calculation model to be used by the arithmetic processor 30*c* may be any other calculation models that is a multivariate analysis technique capable of calculating the moisture content on the surface of the paper sheet P by using absorbance calculated for each of different wavelengths of light illuminated by the illuminator 21. For example, the arithmetic processor 30*c* may calculate the moisture content on the surface of the paper sheet P by using other analytical techniques such as the Partial Linear Square (PLS) regression analysis.

The image forming device according to one aspect of the invention may include a thickness sensor. With the thickness sensor, a thickness of the paper sheet P can be measured, and the controller 30 can accurately control the amount of light illuminated from the illuminator 21 in accordance with the measured thickness of the paper sheet P.

In the present embodiment, the copier 1A is described as an image forming device, but the image forming device according to one aspect of the invention is not limited to a copier. The image forming device may be a commercial printing machine, a printer, a facsimile machine, or the like if printing is performed under conditions in which a moisture content is changed due to, for example, heating for the fixing process. When the image forming device is a commercial printing machine, a printer, or a facsimile machine, the image forming device will receive image data as data in substitution for the original reading process (step S4 in FIG. 5).

The copier 1A according to the present embodiment includes a single photosensitive drum. However, the image forming device according to one aspect of the invention is not limited to the same. The image forming device according to one aspect of the invention may be an image forming device capable of perform color printing on the paper sheet P.

For color printing, the image forming device may have a single-drum system in which a single photosensitive drum carries each color toner image or a multi-drum system in which a plurality of photosensitive drums carry toner images of different colors. When printing including a step of heating a paper sheet is performed, the moisture content varies before and after that step and the same problem will occur in both systems. Therefore, also for color printing, appropriate printing can be performed by adjusting the print conditions in accordance with the moisture content in the copier 1A according to the present embodiment.

<Modification>

Figure 7:
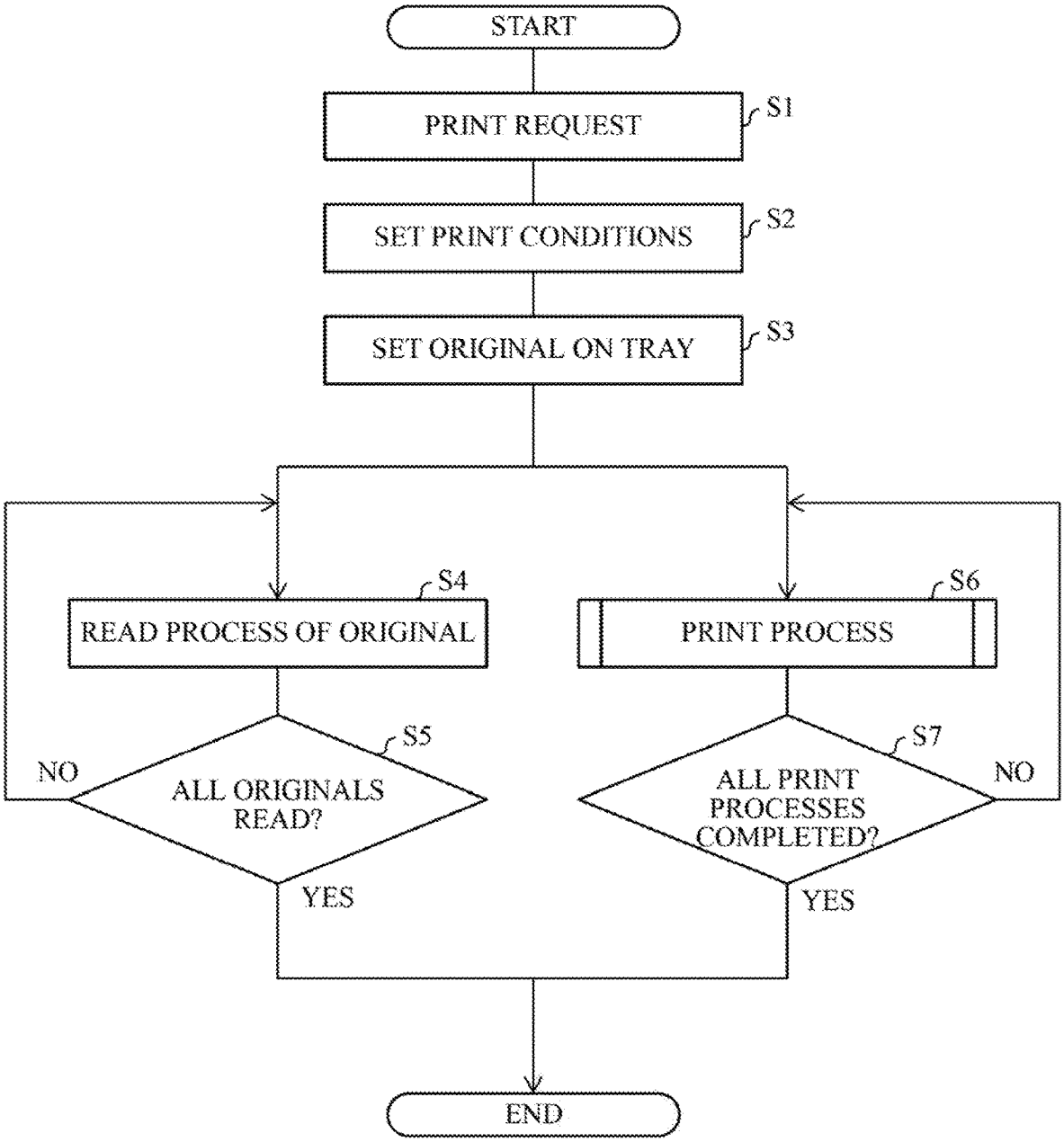
FIG. 7 is a flowchart showing operation of performing both-sided printing on a paper sheet by using a copier as a modification of Embodiment 1.

Here, print operation of a copier as a modification according to the present embodiment will be described with reference to FIG. 7. FIG. 7 is a flowchart showing operation of performing both-sided printing on a paper sheet P by using a copier as a modification according to the present embodiment.

As shown in FIG. 5, the above copier 1A starts a print process (S6) after reading of all the originals is completed in step S5. Generally, however, a demand for an increase in a printing speed is extremely severe for multifunctional peripherals, and it is necessary to start the print process without waiting for the completion of the reading of the original in order to reduce the time as much as possible, even one second.

Therefore, the copier as a modification performs the original reading process (S4) and the print process (S6) at the same time as shown in FIG. 7. For example, the two processes are performed in parallel: while the first sheet of the original is being read, measurement of the standard reflecting plate 6 is started. This can reduce time for the print process when printing image data of a plurality of originals on a plurality of paper sheets P.

Embodiment 2

Another embodiment of the present invention will be described below. For the purpose of illustration, components having the same functions as those described in the first embodiment are denoted by the same reference numerals, and are not described.

A copier 1B as an image forming device according to the present embodiment differs from the copier 1A in Embodiment 1 in that a optical sensor 40 is further provided in the paper feed cassette 3.

(Structure of Copier 1B)

Figure 8:
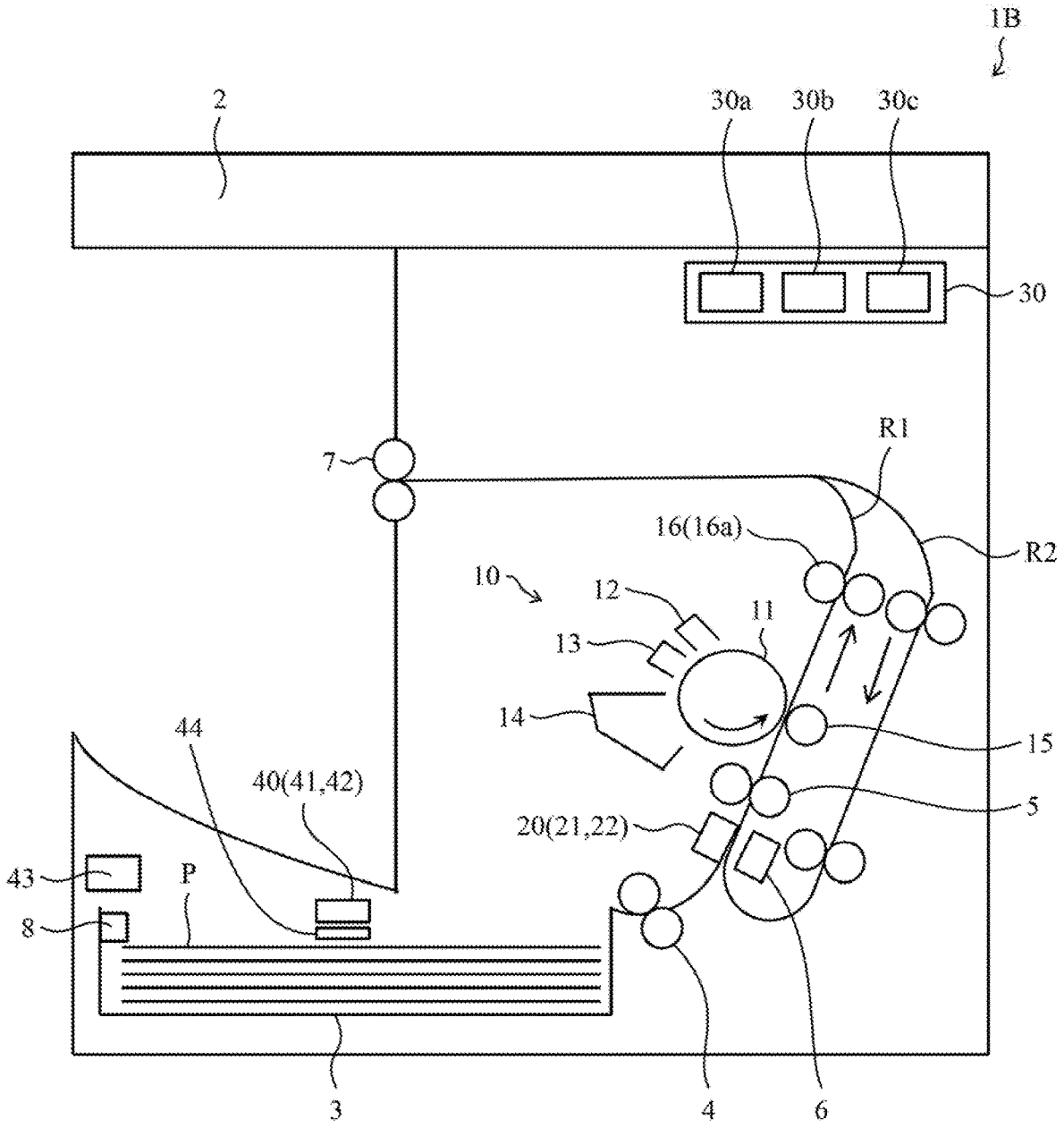
FIG. 8 is a schematic diagram illustrating a structure of a copier according to Embodiment 2 of the invention.

A structure of the copier 1B according to the present embodiment will be described with reference to FIG. 8. FIG. 8 is a schematic diagram illustrating the structure of the copier 1B.

The copier 1B includes, as illustrated in FIG. 8, a optical sensor (first measurement unit) 40, a driving unit 43, and a standard reflecting plate 44 in addition to the structure of the copier 1A.

The optical sensor 40 illuminates a paper sheet P contained in the paper feed cassette 3 with light and measures intensity of light reflected from the surface of the paper sheet P. The optical sensor 40 includes an illuminator 41 and a photodetector 42. The structure of the illuminator 41 and the structure of the photodetector 42 are the same as those of the illuminator 21 and the photodetector 22 of the optical sensor (the second measurement unit) 20 in Embodiment 1, and are not described.

The driving unit 43 is used to move the optical sensor 40. In particular, when the optical sensor 40 does not measure intensity of light reflected from the surface of the paper sheet P contained in the paper feed cassette 3, the driving unit 43 moves the optical sensor 40 to the side of the paper feed cassette 3. When the optical sensor 40 measures the intensity of light, the driving unit 43 moves the optical sensor 40 to a position above the paper feed cassette 3 (that is, a position above the paper sheets P contained in the paper feed cassette 3).

The standard reflecting plate 44 is a reflector used to reflect light illuminated from the illuminator 41 of the optical sensor 40 toward the photodetector 42 of the optical sensor, and is disposed on the same side as that of the optical sensor 40 in the paper feed cassette 3. However, the position at which the standard reflecting plate 44 is disposed is not limited to the same. The position at which the standard reflecting plate 44 is disposed may be a position at which the light illuminated from the illuminator 41 and reflected from the standard reflecting plate 44 can be received by the photodetector 42 without being interrupted. The standard reflecting plate 44 is made of the same material as that of the standard reflecting plate 6 in Embodiment 1.

(Print Operation of Copier 1B)

Next, the print operation of the copier 1B according to the present embodiment will be described. The print operation of the copier 1B according to the present embodiment is the same as the print operation of the copier 1A shown in FIG. 5 in Embodiment 1 except for the print process (S6), and only the print process will be described here.

Figure 9:
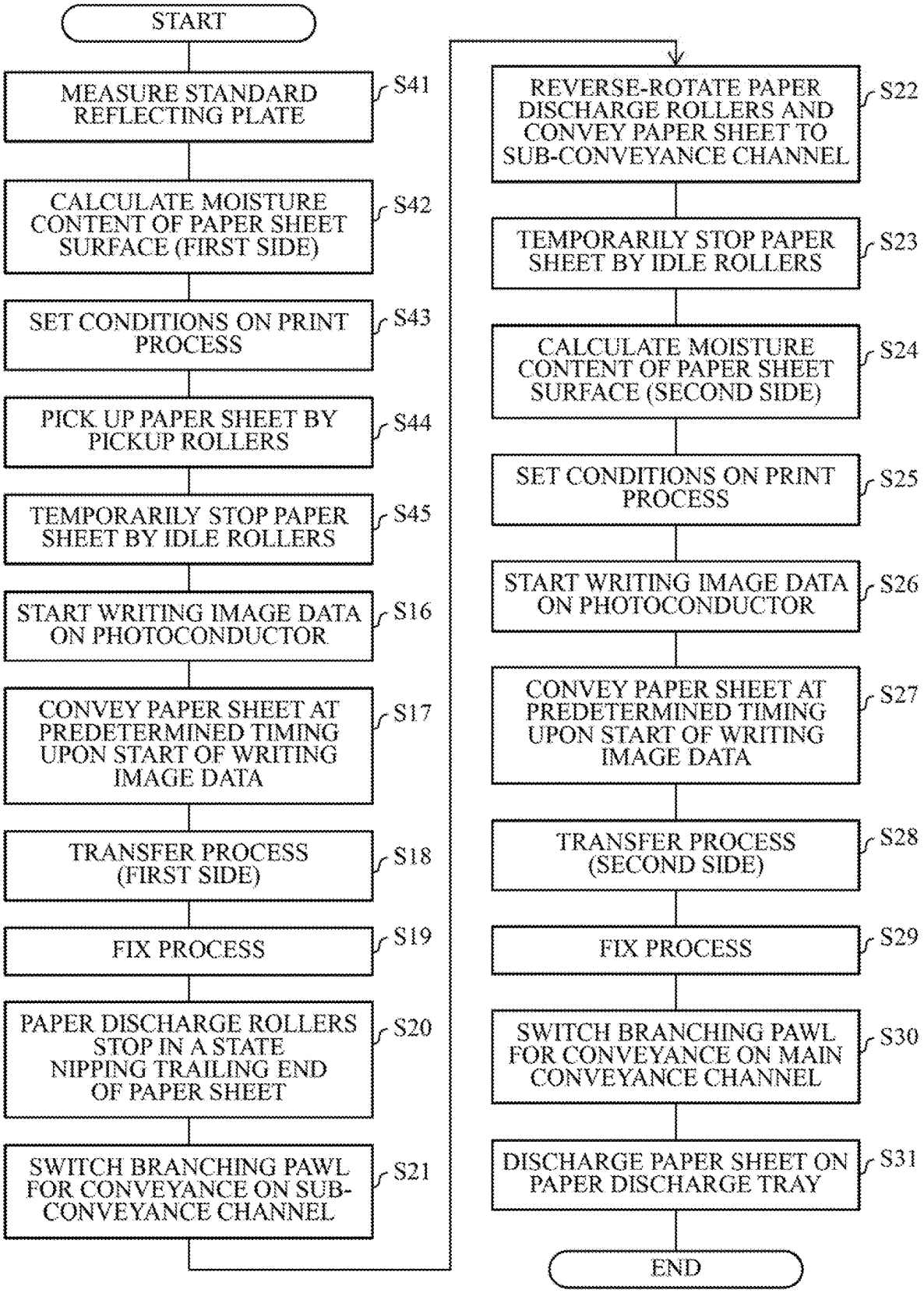
FIG. 9 is a flowchart showing operation of a print process in the above copier.

The print process in the copier 1B will be described with reference to FIG. 9. FIG. 9 is a flowchart showing operation of a print process (image forming method) in the copier 1B.

In the print process on the paper sheet P by the copier 1B, the optical sensor 40 first measures reference data to be used in the calculation of the moisture content on the surface of the paper sheet P by using the standard reflecting plate 44 (S41). The optical sensor 40 is moved to the side of the paper feed cassette 3 by the driving unit 43 before the start of the print process. The optical sensor 40 illuminates the standard reflecting plate 44 positioned on the side of the paper feed cassette 3 with light by using the illuminator 41, receives the light reflected from the surface of the standard reflecting plate 44 by the photodetector 42, measures intensity of the received light, and transmits the measured intensity to the memory 30*a* of the controller 30.

Next, the arithmetic processor 30*c* calculates the moisture content on the surface of the first side of the paper sheet P (S42, measurement step). Specifically, the driving unit 43 first moves the optical sensor 40 to a position above the paper feed cassette 3 (a position above the paper sheets P contained in the paper feed cassette 3). The illuminator 41 of the optical sensor 40 then illuminates the paper sheet P contained in the paper feed cassette 3 with light and the photodetector 42 receives the light reflected from the paper sheet P. Measurement of the light intensity by the optical sensor 40 is performed at two positions of the paper sheet P as in the copier 1A of Embodiment 1. Specifically, measurement at a first position is performed in a state in which the paper sheet P is contained in the paper feed cassette 3. Measurement at a second position is performed in a state in which the paper sheet P is fed a predetermined distance from the paper feed cassette 3 by the pickup rollers 4, and is temporarily stopped by the pickup rollers 4. The light reflected from the paper sheet P includes information about the moisture content on the surface of the paper sheet P, specifically, information about absorbance on the surface of the paper sheet P. The light intensity measured by the photodetector 42 is output to the memory 30*a* of the controller 30.

Next, the arithmetic processor 30*c* of the controller 30 calculates the moisture content on the surface of the paper sheet P by using the light intensity measured by the optical sensor 40. The calculation method of the moisture content on the surface of the paper sheet P is the same as the calculation method described in Embodiment 1, and is not described.

Next, by using the moisture content on the surface of the first side of the paper sheet P calculated by the arithmetic processor 30*c*, the arithmetic processor 30*c* sets the conditions on the print process (transfer conditions, the transfer voltage applied to the transfer device 15, and the transfer current supplied to the transfer device 15) (S43). The setting method of the conditions on the print process is the same as the setting method described in Embodiment 1, and is not described.

The paper sheet P fed by the pickup rollers 4 from the paper feed cassette 3 is then conveyed to the main conveyance channel R1 (S44).

When the paper sheet P is conveyed on the main conveyance channel R1, the pre-registration sensor detects passing of the paper sheet P and transmits a detection signal to the idle rollers 5. Upon receiving the detection signal from the pre-registration sensor, the idle rollers 5 temporarily stop the paper sheet P conveyed on the main conveyance channel R1 (S45).

The operation hereafter is the same as that of steps S16 to S31 described in embodiment 1, and is not described.

As described above, the copier 1B according to the present embodiment includes the optical sensor 20 and the optical sensor 40. The optical sensor 40 performs measurement about the paper sheet P contained in the paper feed cassette 3. The optical sensor 20 performs measurement about the paper sheet P stopped by the idle rollers 5. The arithmetic processor 30*c* sets the transfer conditions in the transfer process on the first side of the paper sheet P (the first transfer process) by using the light intensity measured by the optical sensor 40. Further, the arithmetic processor 30*c* sets the transfer conditions in the transfer process on the second side of the paper sheet P (the second or subsequent transfer process) using the light intensity measured by the optical sensor 20.

According to the above structure, the arithmetic processor 30*c* can calculate the moisture content on the first side of the paper sheet P at a stage at which the paper sheet P is contained in the paper feed cassette 3. Therefore, since the conditions on the transfer process can be set promptly, time required for printing can be shortened.

Embodiment 3

Another embodiment of the present invention will be described below.

A copier 1C as an image forming device according to the present embodiment differs from the copier 1A in Embodiment 1 in that a optical sensor 50 is further provided near pickup rollers 54 described later.

(Structure of Copier 1C)

Figure 10:
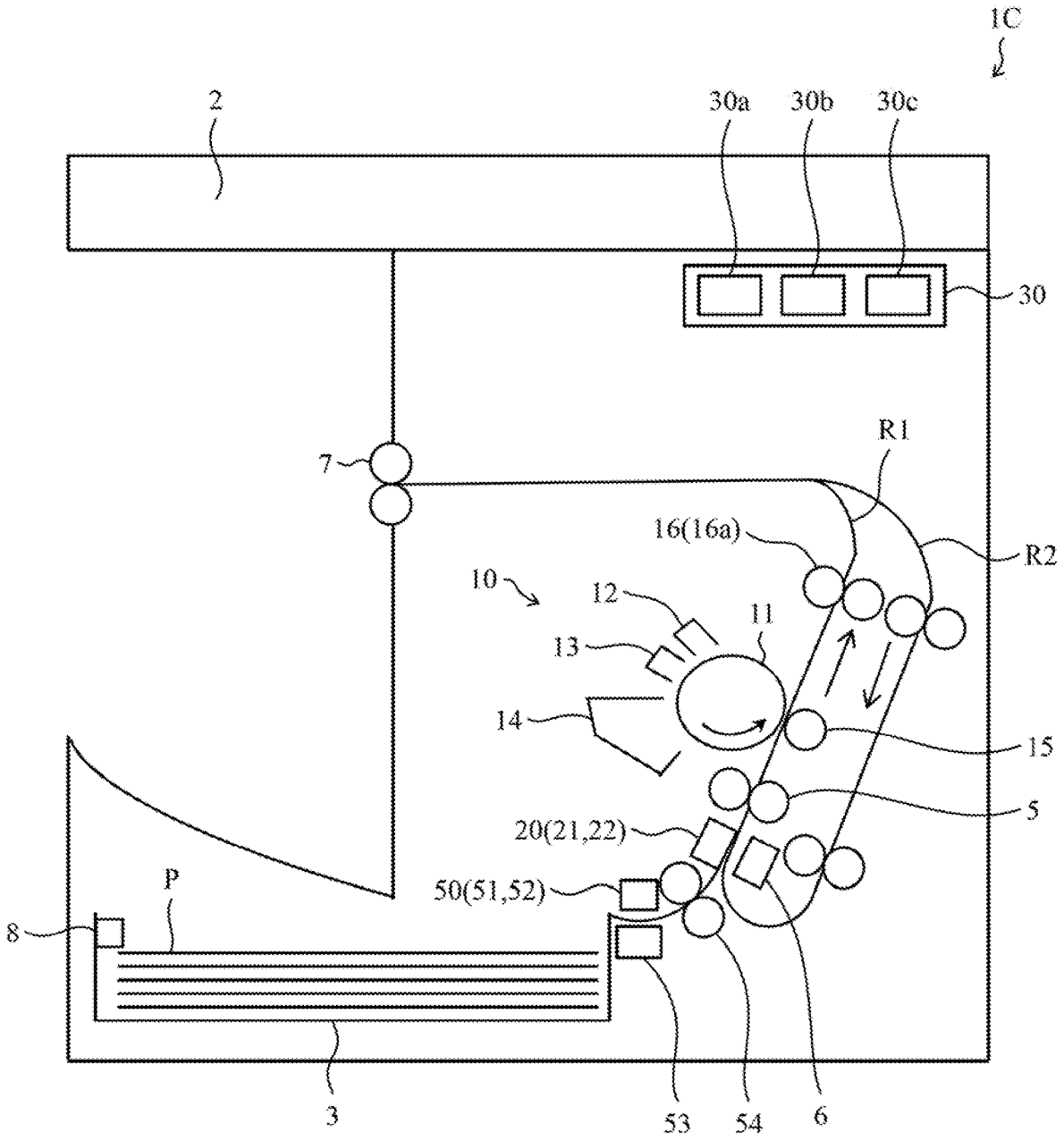
FIG. 10 is a schematic diagram illustrating a structure of a copier according to Embodiment 3 of the invention.

A structure of the copier 1C according to the present embodiment will be described with reference to FIG. 10. FIG. 10 is a schematic diagram illustrating the structure of the copier 1C.

The copier 1C includes, as illustrated in FIG. 10, pickup rollers 54 (feed rollers), a optical sensor (first measurement unit) 50, and a standard reflecting plate 53 in addition to the structure of the copier 1A.

The pickup rollers 54 are rollers for supplying the paper sheet P contained in the paper feed cassette 3 to the main conveyance channel R1. The pickup rollers 54 are capable of temporarily stopping the paper sheet P.

The optical sensor 50 illuminates the paper sheet P temporarily stopped by the pickup rollers 54 with light, receives the light reflected from the paper sheet P, and measures intensity of the received light. The optical sensor 50 includes an illuminator 51 and a photodetector 52. The structure of the illuminator 51 and the structure of the photodetector 52 are the same as those of the illuminator 21 and the photodetector 22 of the optical sensor (the second measurement unit) 20 in Embodiment 1, and are not described.

The standard reflecting plate 53 is a reflector used to reflect light illuminated from the illuminator 51 of the optical sensor 50 toward the photodetector 52 of the optical sensor 50, and is provided to face the optical sensor 50. According to the present embodiment, the standard reflecting plate 53 is provided at a position opposite to the optical sensor 50 with reference to the main conveyance channel R1. In the copier according to one aspect of the invention, however, the position at which the standard reflecting plate 53 is provided is not limited to the same. The position at which the standard reflecting plate 53 is disposed may be a position at which the light illuminated from the illuminator 51 and reflected from the standard reflecting plate 53 can be received by the photodetector 52 without being interrupted. The standard reflecting plate 53 may be built in the optical sensor 50. The standard reflecting plate 53 is made of the same material as that of the standard reflecting plate 6 in Embodiment 1.

(Print Operation of Copier 1C)

Next, print operation of the copier 1C according to the present embodiment will be described. The print operation of the copier 1C according to the present embodiment is the same as the print operation of the copier 1A shown in FIG. 5 in Embodiment 1 except for the print process (S6), and only the print process will be described here.

Figure 11:
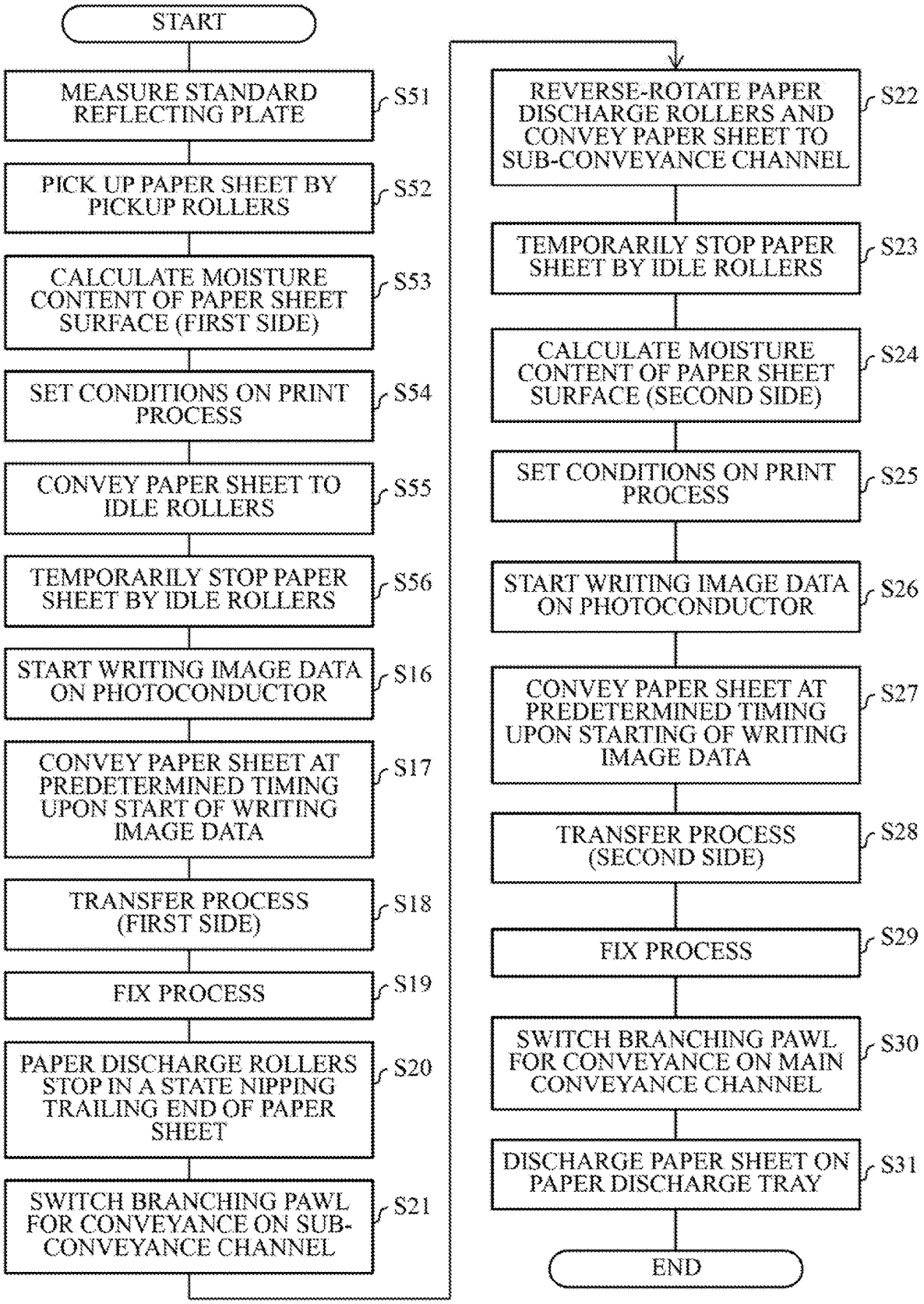
FIG. 11 is a flowchart showing operation of a print process in the above copier.
Figure 12:
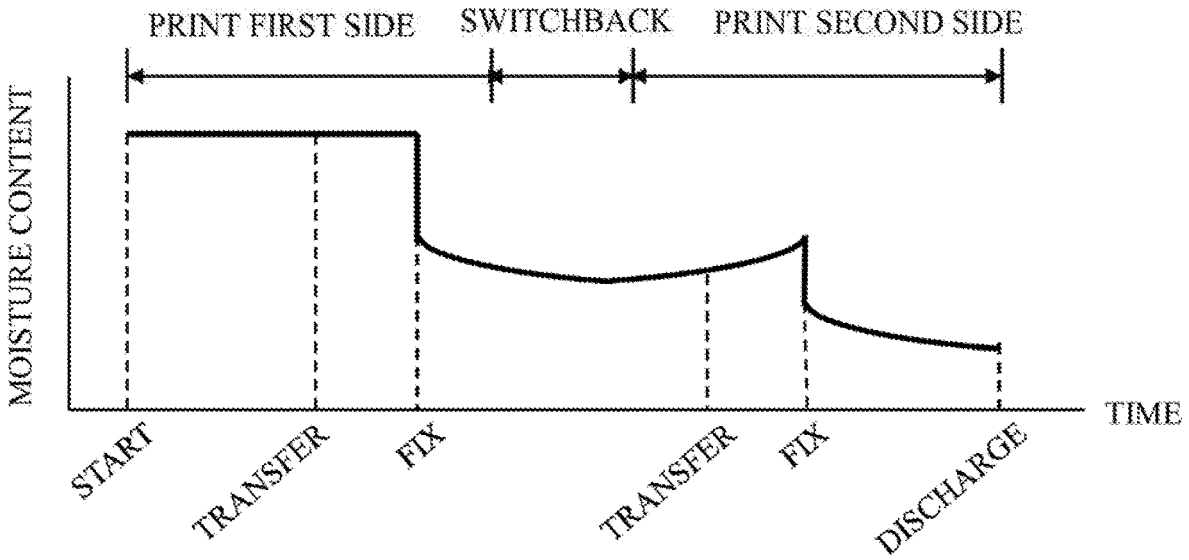
FIG. 12 is a graph showing a change in a moisture content on a surface of a paper sheet during both-sided printing on a paper sheet.
Figure 13:
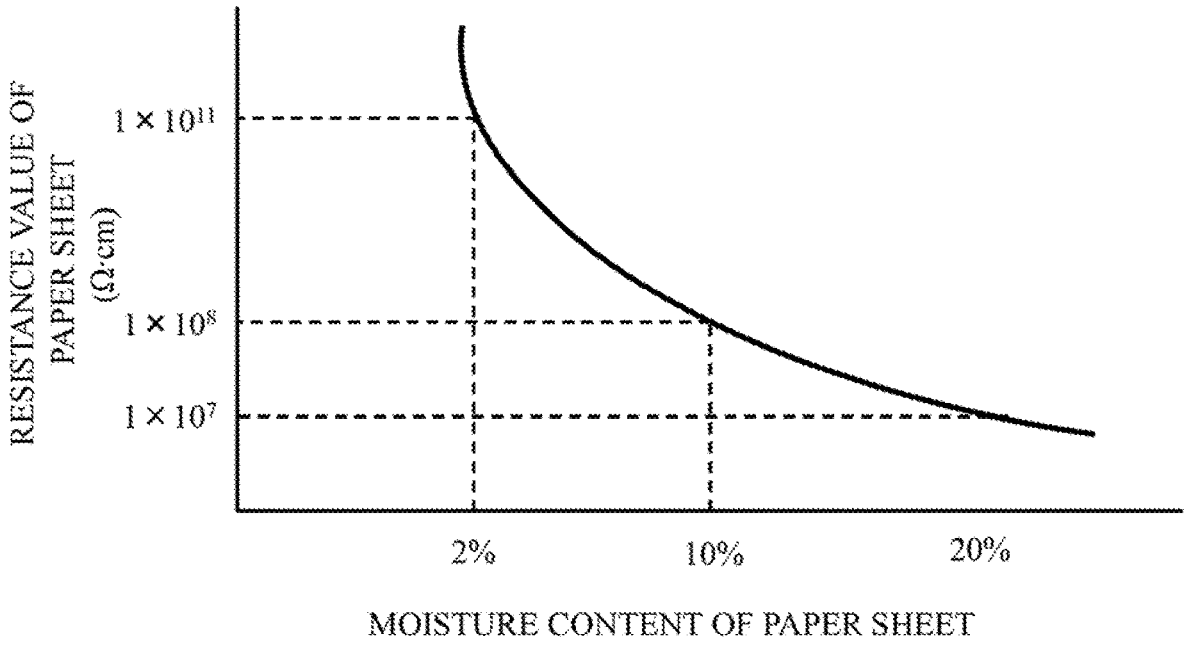
FIG. 13 is a graph showing a relationship between a moisture content on a surface of a paper sheet and a surface resistance value of the paper sheet.

The print process in the copier 1C will be described with reference to FIG. 11. FIG. 11 is a flowchart showing operation of the print process (image forming method) in the copier 1C.

In the print process on the paper sheet P by the copier 1C as shown in FIG. 11, the optical sensor 50 first measures reference data to be used in the calculation of the moisture content on the surface of the paper sheet P by using the standard reflecting plate 53 (S51).

The pickup rollers 54 then take one of the paper sheets P contained in the paper feed cassette 3 (S52) and temporarily stop the paper sheet P.

Next, the arithmetic processor 30*c* calculates the moisture content on the surface of the first side of the paper sheet P (S53, measurement step). Specifically, the illuminator 51 of the optical sensor 50 illuminates the paper sheet P stopped by the pickup rollers 54 with light, and the photodetector 52 receives the light reflected from the paper sheet P. At this time, the light reflected from the paper sheet P includes information about the moisture content on the surface of the paper sheet P, specifically, information about absorbance on the surface of the paper sheet P. The light intensity measured by the photodetector 52 is output to the memory 30*a* of the controller 30. Measurement of light intensity by the optical sensor 50 is performed at two positions of the paper sheet P as in the measurement of light intensity by the optical sensor 20 in the copier 1A of Embodiment 1.

Next, the arithmetic processor 30*c* of the controller 30 calculates the moisture content on the surface of the paper sheet P by using the light intensity measured by the optical sensor 50. The calculation method of the moisture content on the surface of the paper sheet P is the same as the calculation method described in Embodiment 1, and is not described.

Next, by using the moisture content on the surface of the first side of the paper sheet P calculated by the arithmetic processor 30*c*, the arithmetic processor 30*c* sets the conditions on the print process (transfer conditions, the transfer voltage applied to the transfer device 15, and the transfer current supplied to the transfer device 15) (S54, setting process). The setting method of the conditions on the print process is the same as the setting method described in Embodiment 1, and is not described.

Stop of the paper sheet P by the pickup rollers 54 is then canceled and the paper sheet P is conveyed to the idle rollers 5 (S55).

Next, the pre-registration sensor detects passing of the paper sheet P and transmits a detection signal to the idle rollers 5. Upon receiving the detection signal from the pre-registration sensor, the idle rollers 5 temporarily stop the paper sheet P conveyed on the main conveyance channel R1 (S56).

The operation hereafter is the same as that of steps S16 to S31 described in embodiment 1, and is not described.

As described above, the copier 1C includes the optical sensor 20 and the optical sensor 50. The optical sensor 50 performs measurement about the paper sheet P that is taken out of the paper feed cassette 3 by the pickup rollers 54 and is temporarily stopped by the pickup rollers 54. The optical sensor 20 performs measurement about the paper sheet P stopped by the idle rollers 5. The arithmetic processor 30*c* sets the transfer conditions in the transfer process on the first side of the paper sheet P (the first transfer process) by using the light intensity measured by the optical sensor 50. Further, the arithmetic processor 30*c* sets the transfer conditions in the transfer process on the second side of the paper sheet P (the second or subsequent transfer process) using the light intensity measured by the optical sensor 20.

According to the above structure, the arithmetic processor 30*c* calculates the moisture content on the first side of the paper sheet P at a stage at which the paper sheet P is taken out by the pickup rollers 54. Therefore, since the conditions on the transfer process can be set promptly, time required for printing can be shortened.

[Outline]

An image forming device (copiers 1A to 1C) according to a first aspect of the invention is provided with an image carrier (photosensitive drum 11) that carries a developed image (toner image) obtained by developing an electrostatic latent image based on image data with a developing agent (toner agent), and a transfer unit (transfer device 15) that performs a transfer process to transfer the developed image (toner image) to a paper sheet (P), in which the transfer process is capable of being performed on a single paper sheet (P) a plurality of times, the image forming device including: a measurement unit (optical sensor 20, 40, 50) provided with at least one light source (semiconductor light emitting element 21*a*, 21*b*, 21*c*), configured to illuminate the paper sheet (P) with light, receive the light reflected from the paper sheet (P), and measure intensity of the received light; and a setter (arithmetic processor 30*c*) configured to, before each of the plurality of times of the transfer processes, calculate a moisture content on a surface of the paper sheet (P) from the light intensity measured by the measurement unit (optical sensor 20, 40, 50), and set a transfer condition of the transfer unit (transfer device 15) in accordance with the calculated moisture content on the surface of the paper sheet (P).

According to the above feature, before each of the plurality of times of the transfer processes, the setter can appropriately set the transfer condition of the transfer unit considering the moisture content on the surface on the side of the paper sheet on which an image is to be formed. Therefore, the image forming device can appropriately transfer a developed image to a paper sheet by using a transfer unit. Therefore, an image forming device capable of achieving uniform image quality for every transfer regardless of a moisture content on a surface of a paper sheet when a plurality of transfer processes is to be made on a single paper sheet can be provided.

An image forming device (copier 1A-1C) according to a second aspect of the invention may include, in the above first aspect, a stop roller (idle roller 5) may be configured to temporarily stop the paper sheet (P) before performing the transfer process on the paper sheet (P). The measurement unit (optical sensor 20) may perform measurement on the paper sheet (P) stopped by the stop roller (idle roller 5).

According to the above structure, since the measurement unit can measure the light intensity in a state in which the paper sheet is stopped by the stop roller, time required for forming an image can be shortened.

An image forming device (copier 1B) according to a third aspect of the invention may include, in the above first aspect, a paper feed cassette (paper feed cassette 3) configured to contain the paper sheet (P), and a stop roller (idle roller 5) may be configured to temporarily stop the paper sheet (P) before performing a transfer process on the paper sheet (P). The measurement unit may include a first measurement unit (optical sensor 40) and a second measurement unit (optical sensor 20). The first measurement unit (optical sensor 40) may perform measurement about the paper sheet (P) contained in the paper feed cassette (paper feed cassette 3). The second measurement unit (optical sensor 20) may perform measurement about the paper sheet (P) stopped by the stop roller (idle roller 5). The setter (arithmetic processor 30*c*) may set the transfer condition in the first transfer process among the plurality of transfer processes by using the light intensity measured by the first measurement unit (optical sensor 40), and set the transfer condition in a second or subsequent transfer process among the plurality of transfer processes by using the light intensity measured by the second measurement unit (optical sensor 20).

According to the above structure, the setter can calculate the moisture content at the first image formation among a plurality of times of image formation at a stage at which the paper sheet is contained in the paper feed cassette. Therefore, since the condition on the transfer process can be set promptly, time required for printing can be shortened.

In an image forming device (copier 1C) according to a fourth aspect of the invention may include, in the above first aspect, a paper feed cassette (paper feed cassette 3) configured to contain the paper sheet (P), a feed roller (pickup roller 54) configured to take up the paper sheet (P) contained in the paper feed cassette (paper feed cassette 3), and s stop roller (idle roller 5) configured to temporarily stop the paper sheet (P) before performing the transfer process on the paper sheet (P). The measurement unit may include a first measurement unit (optical sensor 50) and a second measurement unit (optical sensor 20). The first measurement unit (optical sensor 50) may perform measurement about the paper sheet (P) taken out of the paper feed cassette (paper feed cassette 3) by the feed roller (pickup roller 54) and temporarily stopped by the feed roller (pickup roller 54). The second measurement unit (optical sensor 20) may perform measurement about the paper sheet (P) stopped by the stop roller (idle roller 5). The setter (arithmetic processor 30*c*) may set the transfer condition in the first transfer process among the plurality of transfer processes by using the light intensity measured by the first measurement unit (optical sensor 50), and set the transfer condition in the first transfer process among the plurality of transfer processes by using the light intensity measured by the first measurement unit (optical sensor 20).

According to the above structure, the setter can calculate the moisture content at the first image formation among a plurality of times of image formation at a stage at which the paper sheet is taken out by the feed roller. Therefore, since the transfer condition can be set promptly, time required for printing can be shortened.

In an image forming device (copier 1A to 1C) according to a fifth aspect of the invention, in any one of above first to fourth aspects, the measurement unit (optical sensor 20, 40, 50) may desirably illuminate light of at least two different wavelengths.

According to the above structure, since the measurement unit can illuminate light of different wavelengths, when calculating the moisture content on the surface of the paper sheet in the setter, the moisture content can be calculated accurately.

In an image forming device (copier 1A to 1C) according to a sixth aspect of the invention, in any one of above first to fifth aspects, measurement of light intensity by the measurement unit (optical sensor 20, 40, 50) may desirably be performed at least two positions of a paper sheet (P): a central position and an edge position.

According to the above structure, the setter can calculate the moisture content on the surface of the paper sheet at each measurement position and can set the transfer condition by using a mean value thereof. Therefore, an influence of distribution of the moisture content on the surface of the paper sheet in setting the transfer condition on the paper sheet can be reduced.

In an image forming device (copier 1A to 1C) according to a seventh aspect of the invention, in any one of above first to sixth aspects, the transfer condition may include at least one of a voltage value to be applied to the transfer unit and a current value to be supplied to the transfer unit (transfer device 15).

According to the above structure, the setter sets a voltage value applied to the transfer unit and a current value supplied to the transfer unit appropriately in accordance with the moisture content on the surface of the paper sheet. Therefore, when a plurality of times of image formation is to be performed on a single paper sheet, uniform image quality for every image formation regardless of the moisture content on the surface of the paper sheet can be achieved.

In an image forming device (copier 1A to 1C) according to a fifth aspect of the invention, in any one of above first to seventh aspects, the transfer condition may desirably set for each predetermined range of the moisture content.

According to the above structure, the setter can set an appropriate transfer condition in accordance with the moisture content on the surface of the paper sheet calculated by the setter.

In an image forming device (copier 1A to 1C) according to a ninth aspect of the invention, in any one of above first to eighth aspects, a wavelength of light emitted by the light source (semiconductor light emitting element 21*a*, 21*b*, 21*c*) may desirably be 2,000 nm or shorter.

According to the above structure, since the wavelength of light emitted by the light source is 2,000 nm or shorter, absorption of the emitted light by the moisture contained in the paper sheet cannot be excessively large. Therefore, calculation accuracy of the moisture content on the surface of the paper sheet can be improved.

An image forming method according to a tenth aspect of the invention is an image forming method in an image forming device provided with an image carrier (photosensitive drum 11) that carries a developed image (toner image) obtained by developing an electrostatic latent image based on image data with a developing agent (toner agent), and a transfer unit (transfer device 15) that performs a transfer process to transfer the developed image (toner image) to a paper sheet (P), in which the transfer process is capable of being performed on a single paper sheet (P) a plurality of times. The image forming method includes: a measuring step of illuminating the paper sheet (P) with light from at least one light source, receiving the light reflected from the paper sheet (P), and measuring intensity of the received light; and a setting step of, before each of the plurality of times of the transfer processes, calculating a moisture content on a surface of the paper sheet (P) from the light intensity measured in the measuring step, and setting a transfer condition of the transfer unit in accordance with the calculated moisture content on the surface of the paper sheet (P).

According to the above feature, before each of the plurality of times of the transfer processes, the transfer condition of the transfer unit can be set appropriately considering the moisture content on the surface on the side of the paper sheet on which an image is to be formed. Therefore, transfer of a developing agent image to a paper sheet by the transfer unit can be performed appropriately. As a result, an image forming device capable of achieving uniform image quality for every image formation regardless of the moisture content on the surface of the paper sheet when a plurality of times of image formation is to be performed on a single paper sheet can be provided.

One aspect of the invention is not limited to each embodiment described above and various changes may be made without departing from the scope of the invention as claimed. Embodiments provided by combining technical means disclosed in different embodiments also fall within the technical scope of one aspect of the invention. Furthermore, New technical feature can be formed by putting technical means which is disclosed in each embodiment, respectively, together.

CROSS-REFERENCE TO RELATED APPLICATION

The present application claims priority under 35 U.S.C. § 119 to Japanese Patent Application No. 2016-078974 filed on Apr. 11, 2016, which is hereby incorporated by reference in its entirety herein.

DESCRIPTION OF REFERENCE NUMERALS

1A-1C Copier (image forming device)
3 Paper feed cassette
4, 54 Pickup rollers (feed rollers)
5 Idle rollers (stop rollers)
11 Photosensitive drum (image carrier)
14 Developing device (developing unit)
15 Transfer device (transfer unit)
20 Optical sensor (measurement unit, second measurement unit)
21, 41, 51 Illuminator
21*a*, 21*b*, 21*c* Semiconductor light emitting element (light source)
30 Controller
30*c* Arithmetic processor (setter)
40 Optical sensor (measurement unit, first measurement unit)
50 Optical sensor (measurement unit, first measurement unit)
P Paper sheet

The invention claimed is:

1. An image forming device provided with an image carrier that carries a developed image obtained by developing an electrostatic latent image based on image data with a developing agent, and a transfer unit that performs a transfer process to transfer the developed image to a paper sheet, in which the transfer process is capable of being performed on the paper sheet a plurality of times, the image forming device comprising:

a measurement unit provided with at least one light source, configured to illuminate the paper sheet with light, receive the light reflected from the paper sheet, and measure intensity of the light;

a setter configured to, before each of the plurality of times of the transfer processes, calculate a moisture content on a surface of the paper sheet from the light intensity measured by the measurement unit, and set a transfer condition of the transfer unit in accordance with the moisture content on the surface of the paper sheet;

a paper feed cassette configured to contain the paper sheet; and a stop roller configured to temporarily stop the paper sheet before performing the transfer process on the paper sheet, wherein:

the measurement unit includes a first measurement unit and a second measurement unit;

the first measurement unit performs measurement about the paper sheet contained in the paper feed cassette;

the second measurement unit performs measurement about the paper sheet stopped by the stop roller; and the setter sets the transfer condition in a first transfer process among the plurality of transfer processes by using the light intensity measured by the first measurement unit, and sets the transfer condition in a second or subsequent transfer process among the plurality of transfer processes by using the light intensity measured by the second measurement unit.

2. The image forming device according to claim 1, wherein the measurement unit illuminates the light of at least two different wavelengths.

3. The image forming device according to claim 1, wherein measurement of the light intensity by the measurement unit is performed at least two positions of a paper sheet: a central position and an edge position.

4. The image forming device according to claim 1, wherein the transfer condition includes at least one of a voltage value to be applied to the transfer unit and a current value to be supplied to the transfer unit.

5. The image forming device according to claim 1, wherein the transfer condition is set for each predetermined range of the moisture content.

6. The image forming device according to claim 1, wherein a wavelength of the light emitted by the light source is 2,000 nm or shorter.

7. An image forming device provided with an image carrier that carries a developed image obtained by developing an electrostatic latent image based on image data with a developing agent, and a transfer unit that performs a transfer process to transfer the developed image to a paper sheet, in which the transfer process is capable of being performed on the paper sheet a plurality of times, the image forming device comprising:

a measurement unit provided with at least one light source, configured to illuminate the paper sheet with light, receive the light reflected from the paper sheet, and measure intensity of the light;

a setter configured to, before each of the plurality of times of the transfer processes, calculate a moisture content on a surface of the paper sheet from the light intensity measured by the measurement unit, and set a transfer condition of the transfer unit in accordance with the moisture content on the surface of the paper sheet;

a paper feed cassette configured to contain the paper sheet;

a feed roller configured to take up the paper sheet contained in the paper feed cassette; and a stop roller configured to temporarily stop the paper sheet before performing the transfer process on the paper sheet, wherein:

the measurement unit includes a first measurement unit and a second measurement unit;

the first measurement unit performs measurement about the paper sheet taken out of the paper feed cassette by the feed roller and temporarily stopped by the feed roller;

the second measurement unit performs measurement about the paper sheet stopped by the stop roller; and the setter sets the transfer condition in a first transfer process among the plurality of transfer processes by using the light intensity measured by the first measurement unit, and sets the transfer condition in a second or subsequent transfer process among the plurality of transfer process by using the light intensity measured by the second measurement unit.

8. The image forming device according to claim 7, wherein the measurement unit illuminates the light of at least two different wavelengths.

9. The image forming device according to claim 7, wherein measurement of the light intensity by the measurement unit is performed at least two positions of a paper sheet: a central position and an edge position.

10. The image forming device according to claim 7, wherein the transfer condition includes at least one of a voltage value to be applied to the transfer unit and a current value to be supplied to the transfer unit.

11. The image forming device according to claim 7, wherein the transfer condition is set for each predetermined range of the moisture content.

12. The image forming device according to claim 7, wherein a wavelength of the light emitted by the light source is 2,000 nm or shorter.

13. An image forming method in an image forming device provided with an image carrier that carries a developed image obtained by developing an electrostatic latent image based on image data with a developing agent, and a transfer unit that performs a transfer process to transfer the developed image to a paper sheet, in which the transfer process is capable of being performed on the paper sheet a plurality of times, the image forming method comprising:

first measuring intensity of received light by illuminating the paper sheet contained in a paper feed cassette with light from at least one light source and receiving the light reflected from the paper sheet;

second measuring intensity of received light by illuminating the paper sheet stopped by a stop roller configured to temporarily stop the paper sheet before performing the transfer process on the paper sheet; and before each of the plurality of times of the transfer processes, setting a transfer condition of the transfer unit in accordance with a calculated moisture content on a surface of the paper sheet by calculating the moisture content on the surface of the paper sheet from the intensity of the received light measured in the measuring, wherein the transfer condition in a first transfer process among the plurality of transfer processes is set by using the light intensity measured by the first measuring, and the transfer condition in a second or subsequent transfer process among the plurality of transfer processes is set by using the light intensity measured by the second measuring.

* * * * *